United States Patent [19]

Mott

[11] 4,295,523

[45] Oct. 20, 1981

[54] WELL SAFETY SYSTEM METHOD AND APPARATUS

[75] Inventor: James D. Mott, Houston, Tex.

[73] Assignee: Hydril Company, Houston, Tex.

[21] Appl. No.: 102,913

[22] Filed: Dec. 12, 1979

Related U.S. Application Data

[62] Division of Ser. No. 2,197, Jan. 9, 1979.

[51] Int. Cl.[3] ..... E21B 43/10

[52] U.S. Cl. ..... 166/250

[58] Field of Search ..... 166/335, 315, 262, 212, 166/250

[56] References Cited

U.S. PATENT DOCUMENTS 3,871,456 3/1975 Sizer ..... 166/315

4,010,804 3/1977 Garcia ..... 166/315

*Primary Examiner*—William F. Pate, III

*Attorney, Agent, or Firm*—Pravel, Gambrell, Hewitt, Kirk, Kimball & Dodge

[57] ABSTRACT

Subsurface apparatus and method for using same in a hydrocarbon producing well to enable retrieval of a full opening subsurface safety valve mounted in the well tubing without disturbing the major portion of the well tubing located below the safety valve. The apparatus includes a subsurface tubing hanger below the safety valve from which the major portion of the well tubing is suspended and through which tubing the hydrocarbons flow to the surface. Disposed above the safety valve is a tubing holddown apparatus and a controllable safety joint. The holddown apparatus provides a lower anchor for the portion of the tubing disposed above the tubing hanger and the stinger which is received in and seals with the tubing hanger. The safety joint is controlled to provide a full strength connection when installing the apparatus and a desired separation point when installed in order that damage to the portion of the tubing above the apparatus would not disturb the subsurface safety valve and thereby affect its ability to shut in the well in the event the wellhead is destroyed or damaged. The apparatus is installed in a single trip and thereby reducing the need for "spacing out" during installation.

In the event of damage or malfunction of the full opening safety valve, the valve may be retrieved with only the upper portion of the well tubing. A replacement valve may then be easily installed.

1 Claim, 27 Drawing Figures

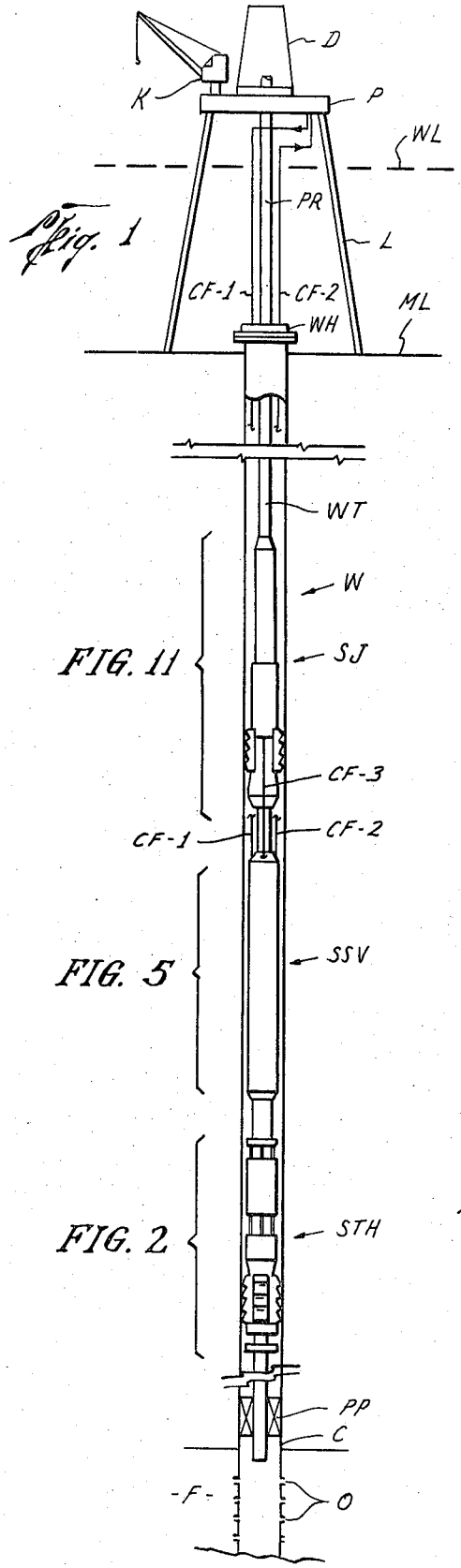
D
K
P
WL
PR
L
CF-1
CF-2
WH
ML
WT
W
SJ
CF-3
CF-1
CF-2
SSV
STH
PP
C
F
O
Fig. 1
FIG. 11
FIG. 5
FIG. 2
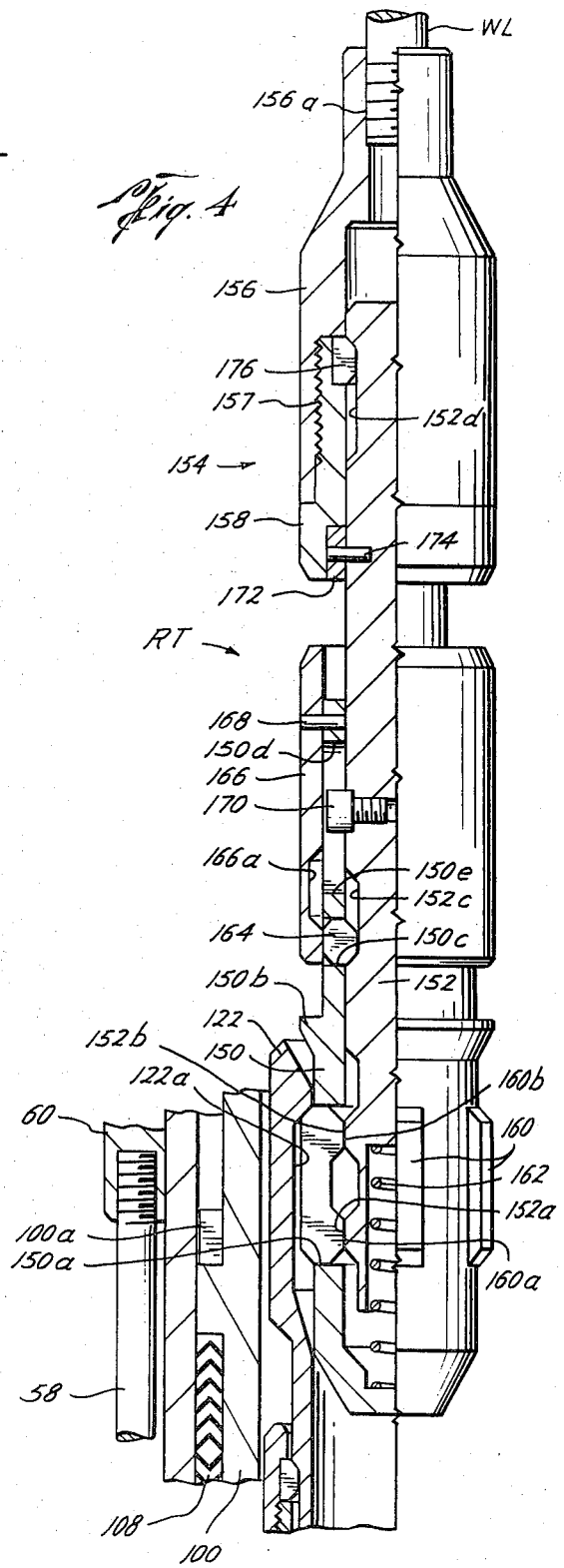
WL
156a
156
176
157
152d
154
158
174
172
RT
168
150d
166
170
166a
150e
152c
164
150c
150b
152
122
152b
150
122a
160b
60
160
162
152a
100a
150a
160a
58
108
100
Fig. 4

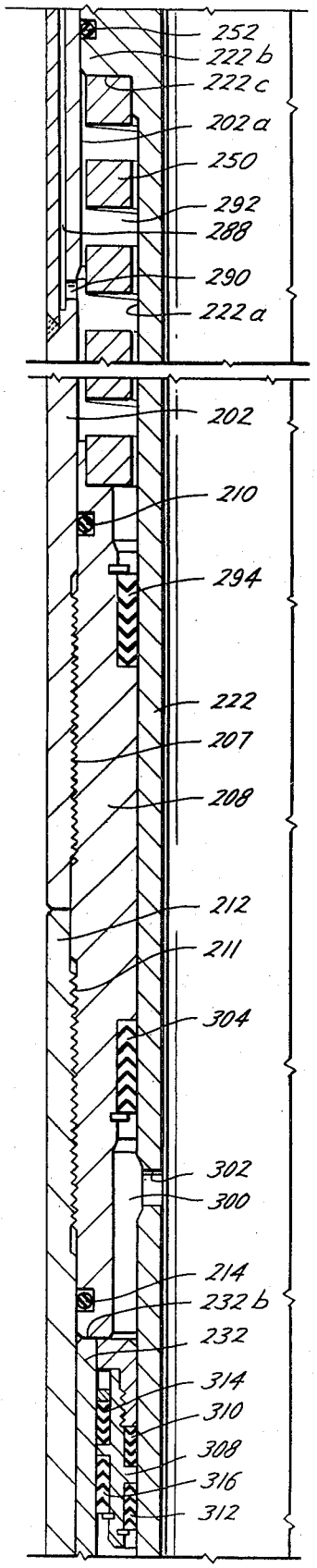
Fig. 5 B
Fig. 7
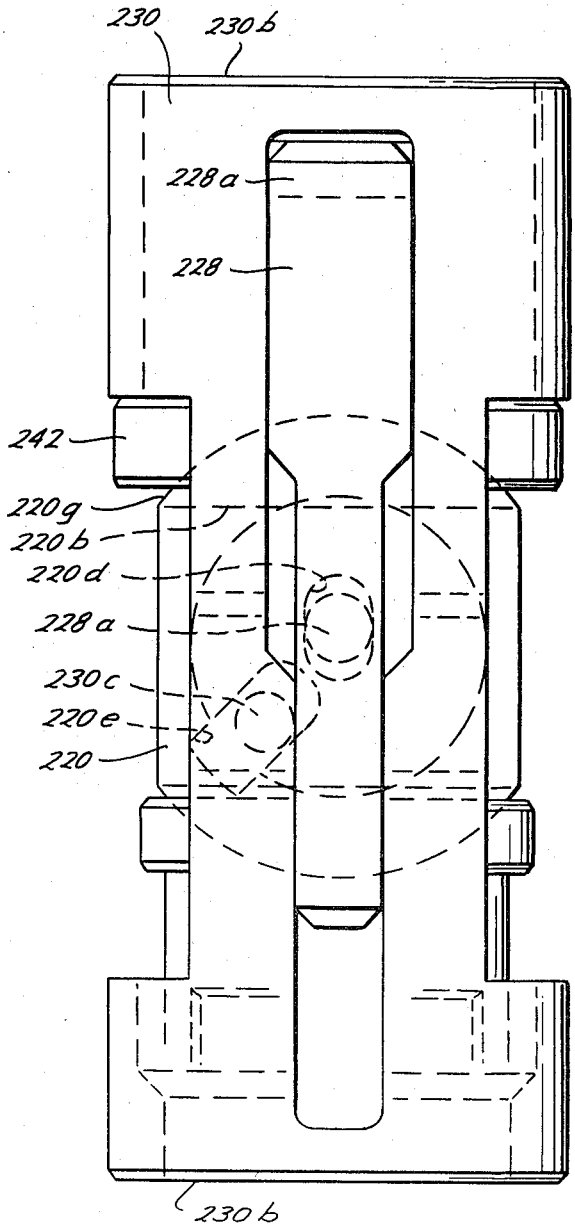

222
223
232
224
SSVB
306
230b
232a
228c
228b
242
243
SSUH
220g
242a
220
220b
228a
228
238
226a
226b
228d
228e
226
236a
236
212
230
234
219
226c
218
240
216

230
230b
230a
228
230c
242
220a
220b
228a
230c
220d
220e
226a
226

SJ
364
366
376
360c
352d
368
370
360a
360b
CF-3
360
356g
361
356
354c
352c
356b
350b
354a
354b
356
350a
351
354
352
350

380
382
378
362a
363
372
374
352d
364
376
366
352
360c
360a
368
370
CF-3
360
361
356a
356b
356
356c
C
354b

WELL SAFETY SYSTEM METHOD AND APPARATUS

This is a division of application Ser. No. 2,197, filed Jan. 9, 1979.

TECHNICAL FIELD

This invention relates to surface controlled subsurface safety systems for use in hydrocarbon producing wells. In particular, this invention relates to the single trip installation, use, operation and retrieval of a full opening subsurface safety valve without the need to remove the entire tubing string from the well. The major portion of the tubing string is suspended from a retrievable subsurface tubing hanger below the safety valve and which lower tubing and subsurface hanger may be retrieved when desired. The entire system is installed in a single trip with a safety joint mounted in the tubing above the valve made operable after setting of the subsurface tubing hanger.

BACKGROUND OF THE INVENTION

This invention relates to the field of surface controlled subsurface safety systems for use in wells producing hydrocarbons.

Perhaps the earliest surface controlled subsurface safety valve system is disclosed in Knox U.S. Pat. No. 2,518,795. Numerous improvements have occurred since that time, but certain problems have remained. In general, well operators have desired a full opening surface controlled subsurface safety valve that can be easily replaced upon failure. These two criteria in the past have led to differing patterns of development which have not been resolved until the present invention.

To achieve the easily replaceable feature, through the tubing bore movable or wireline installed and retrievable surface controlled subsurface safety valve have been developed. See, for example, the following U.S. Pat. Nos.

3,078,923, 3,157,233
3,642,070, 3,675,720
3,747,682, 3,763,933

While those subsurface safety valves had the advantage of easy replacement, they did severely restrict flow through the subsurface safety valve. This not only limited production but often caused flow erosion of the tubing above the valve. This problem was partially solved by my development of a larger diameter ball element as disclosed and claimed in U.S. Pat. No. 3,870,102. Another drawback was the need to remove these valves in order to conduct well servicing operations below the valve.

Full opening subsurface valves, i.e., valves having a flow opening through valve housing substantially equal to the well tubing bore possessed neither of these drawbacks. Flow erosion is reduced and no restriction is presented to running other well tools through the valve when in the open position to perform various operations below the valve. For example, see Keithahn U.S. Pat. No. 2,998,077.

To achieve the full opening, it was necessary to run a tubing retrievable type valve (i.e. retrievable with the tubing from the well) and which formed a portion of the well tubing. This frequently required a larger, expensive casing program to provide clearance for the enlarged outer diameter of the valve housing. In addition, this presented the problem of pulling the entire well tubing string which necessitated killing the well with possible permanent damage to the hydrocarbon producing formation. Since the entire tubing string was required to be supported and manipulated for releasing any packers or other downhole seals and then reinstalling same, expensive workover rigs were required to replace tubing retrievable safety valves.

In weighing the business risks, the operators have tended to prefer wireline retrievable surface controlled subsurface valves. However, the capability of installing a wireline retrievable valve in a tubing retrievable valve, such as disclosed in my patent application Ser. No. 72,034, filed Sept. 14, 1970 (now abandoned after filing continuation application Ser. No. 256,194, filed May 23, 1972) offered the compromise of installing a wireline retrievable valve in a locked open tubing retrievable valve. This concept was further refined in Mott U.S. Pat. No. 3,744,564 which disclosed that when tubing retrievable valve failure occurred a wireline retrievable valve could be installed and operated by the controls of the tubing retrievable valve.

Another concept of using a full opening tubing retrievable valve is retrieving only the portion of the tubing above the safety valve. Examples of such concept are found in the following U.S. Pat. Nos.

3,842,913
3,870,104
3,844,346

A drawback to such concept was that it required the well to be cased and completed in a manner that limited the well operator's flexibility in maintaining the well.

A similar arrangement has been the installation of a full opening surface controlled subsurface safety valve in a tubing hanger suspended below the mudline. For example, see Crowe U.S. Pat. No. 3,771,603, which discloses such a tubing hanger with the full opening surface controlled subsurface safety valve installed in the tubing hanger.

These subsurface safety systems generally require the use of an installation tool for setting the tubing hanger which was followed by the installation of the subsurface safety valve. An example of such a running tool is disclosed in U.S. Pat. No. 4,067,388. Because of the necessity to "space out" during the second trip installation time was often lengthy with this equipment. Removal operations were the same in that the safety valve was removed by pulling the stinger of the valve from the tubing hanger and thereafter using a retrieving tool to retrieve the tubing hanger and the production tubing secured in the well below the tubing hanger. Such operations were very lengthy and as the workover equipment necessary to perform installation and retrieval is generally rented, such operations were extremely costly to the operator and therefore extremely undesirable.

The Model TA tubing hanger anchor manufactured by Brown Oil Tools, Inc. enables the installation of a full opening subsurface safety valve in a single trip. The subsurface tubing hanger is hydraulically set and the setting mechanism remains exposed to well fluid pressure during production. This creates an additional risk of tubing leakage. In addition, the safety joint disposed in the tubing above the safety valve limited the weight of the equipment that could be installed on the single trip.

Despite such drawbacks, such tubing hanger systems are desirable in that the full opening valve may be retrieved and replace without the need for a workover rig. Offshore platforms are usually equipped with cranes and by proper location of the tubing hanger, the cranes could be used to lift the upper portion of the tubing to replace the safety valve. In view of the cost as well as availability of workover rigs, this was extremely desirable.

DISCLOSURE OF THE INVENTION

A safety system for a hydrocarbon producing well to enable retrieval of a full opening subsurface safety valve without disturbing the major portion of the well tubing which is disposed below the safety valve.

A subsurface tubing hanger is mounted in the well tubing below the full opening subsurface safety valve for supporting the tubing therebelow while the subsurface safety valve is retrieved for repair or replacement. A holddown and safety joint are connected in the well tubing above the safety valve. During installation operations the safety joint is rated at the strength of the well tubing but after the holddown is set the safety joint is activated for failure at a safety factor portion of the strength of the well tubing. The safety joint will ensure separation of the well tubing in the event of damage to the wellhead.

The safety valve may be released from the tubing hanger and retrieved with only the upper portion of the tubing to enable its repair or replacement without disturbing the major portion of the tubing. The safety valve may then be reinstalled with the holddown and safety joint acting in the previously disclosed manner. When it is desired to retrieve the entire string of tubing the tubing hanger may be released and the entire string of tubing pulled from the well.

The entire system may be run in a single trip which eliminates "spacing out" problems. In addition, during installation the entire tubing string may be reciprocated or rotated as desired to operate other downhole well tools such as packers without prematurely actuating the apparatus of the present invention which is set hydraulically. However, increased fluid pressure in the bore of the tubing tends to maintain the apparatus in the unactuated condition for enabling fluid circulation prior to setting. The method of installation also ensures that the tubing hanger is supporting the major portion of the tubing before actuating the safety joint or holddown.

BRIEF DESCRIPTION OF THE DRAWINGS

FIG. 1 is a schematic side view, partially in section, of a hydrocarbon-producing well having the subsurface apparatus of the present invention operably installed therein;

FIG. 4 is a side view in section illustrating the operation of the apparatus for retrieving the setting apparatus for the subsurface tubing hanger apparatus illustrated in FIGS. 2 and 3;

FIGS. 5A, 5B, 5C and 5D are side views, in section, from top to bottom, of the bracketed portion referenced as FIG. 5 in FIG. 1 of the subsurface safety valve apparatus of the present invention in the closed position;

FIGS. 7, 8 and 9 are side views illustrating the movement of the ball element from the closed to the open position;

BEST MODE OF OPERATION

Figure 2A:
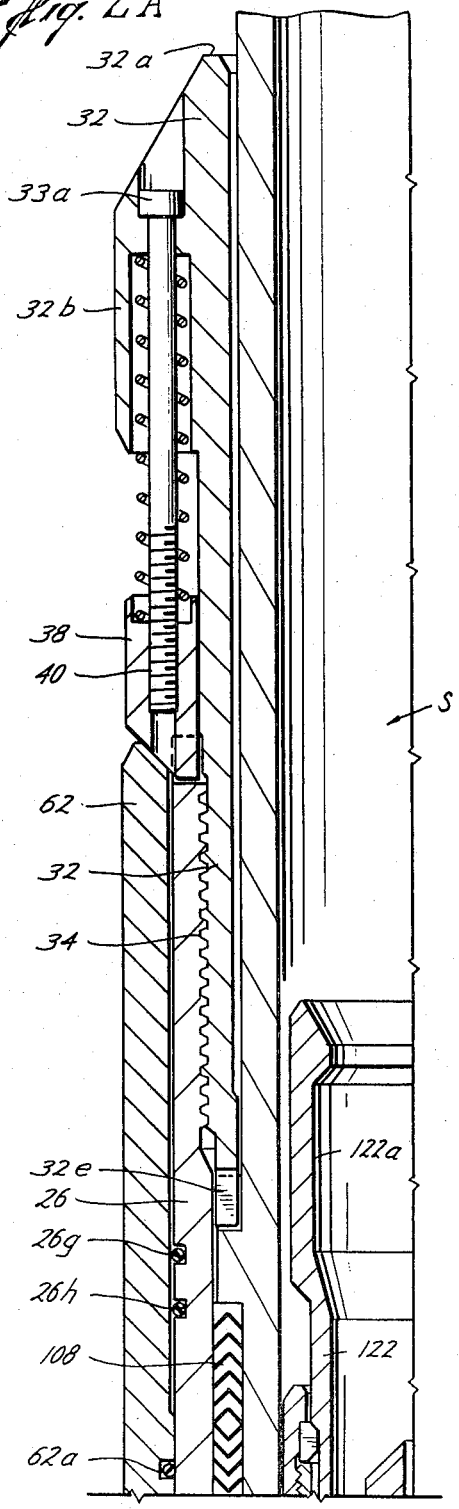
FIGS. 2A, 2B and 2C are side views in section of the bracketed portion referenced as FIG. 2 in FIG. 1 arranged from the top of the tubing hanger apparatus and extending to the bottom with the subsurface tubing hanger in the condition when moving into the well.

In FIG. 1 is illustrated the well safety apparatus of the present invention, generally designated A, operatively installed in a hydrocarbon producing well W. Although the well of FIG. 1 is illustrated as being an off-shore completed from a platform P above the water level WL, it is understood that the apparatus of the present invention A is equally suitable in a well having a subsea wellhead, such as is disclosed in my U.S. Pat. No. 4,067,387, or in a well located on land.

The platform P is supported by legs L above the water level WL from the earth surface or mudline ML which defines the lower limit to the body of water. A derrick D is disposed upon platform P during drilling of the well W and for supporting the installation of the apparatus A of the present invention. One or more cranes K are also operably mounted on the platform P for loading supplies from support ships (not illustrated) and for a further purpose to be described in detail hereinafter.

The well W is provided with a casing C in the usual manner that extends downwardly through a hydrocarbon producing formation F. Perforations or openings O in the casing C enable passage of the hydrocarbons and other well fluid from the formation F to flow into the tubular casing C where they then flow through the apparatus A of the present invention to a wellhead WH at mudline ML and upwardly through the production riser PR to the platform P where they are handled in the usual manner. In this regard it should be noted that the production riser PR is schematically illustrated as being of smaller diameter than the casing C. However, one skilled in the art will immediately appreciate that this is done merely for purposes of illustration and the production riser will have substantially the same diameter of the casing in order to enable passage of the present apparatus A as well as other well tools.

The apparatus A is made up in and forms a portion of the well tubing WT for flowing well fluids to the platform P. A packer PP seals between the casing C and the outer portion of the well tubing WT above the perforation O for directing flow of well fluids through the bore of the well tubing WT upwardly to the wellhead WH and on upwardly through the production riser PR to the platform P in the usual manner.

As illustrated in FIG. 1, the apparatus of the present invention includes, from bottom to top, a subsurface tubing hanger means, bracketed as FIG. 2 and generally designated STH, a full opening subsurface safety valve, bracketed as FIG. 5 and generally designated SSV, and a holddown and safety joint means, bracketed as FIG. 11 and generally designated SJ.

The subsurface tubing hanger STH, when operably installed, supports the well tubing WT disposed therebelow in the well W. The subsurface tubing hanger STH also receives and seals with a tubing stinger S carried below the subsurface safety valve SSV. The subsurface safety valve which is disposed above the subsurface tubing hanger STH, of course, is used controlled from the surface through conduits CF-1 and CF-2 to control the flow through the bore of the well tubing WT. Disposed above the subsurface safety valve SSV is the holddown and safety joint means SJ. The holddown and safety joint means SJ serves to hold the lower end of the well tubing WT and the stinger S in the subsurface tubing hanger STH with the stinger S sealed to the subsurface tubing hanger STH. The safety joint SJ is disposed above the holddown portion of this means for enabling separation of the well tubing WT at a desired value less than the strength of the well tubing. This enables the subsurface safety valve SSV to function and shut in the well W in the event of damage to the wellhead WH.

Figure 2B:
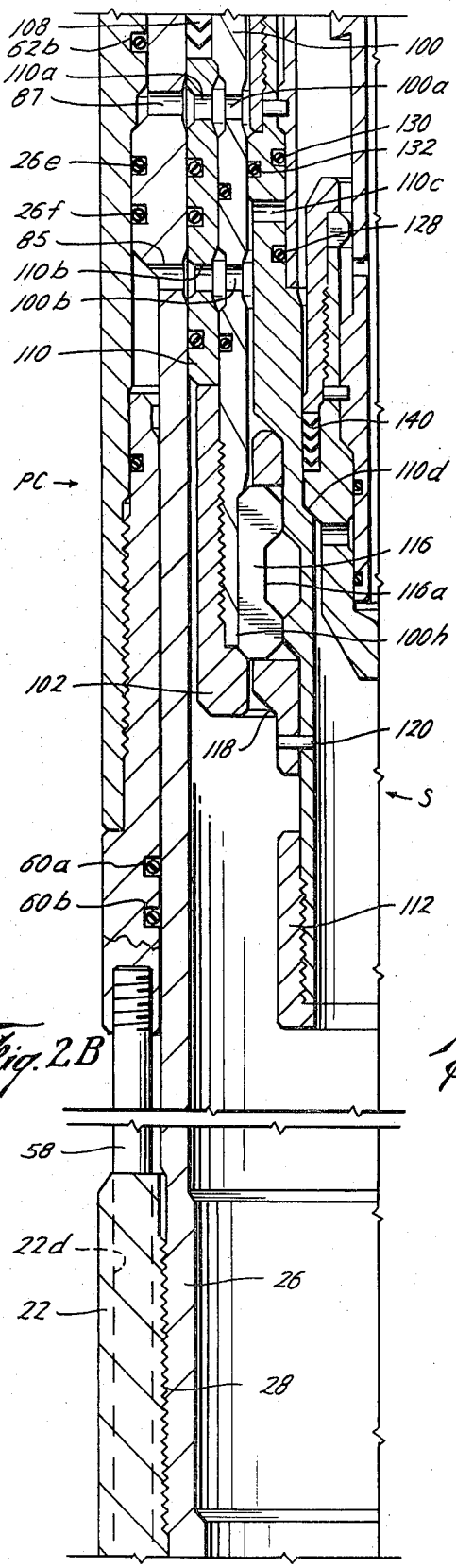
Figure 2C:
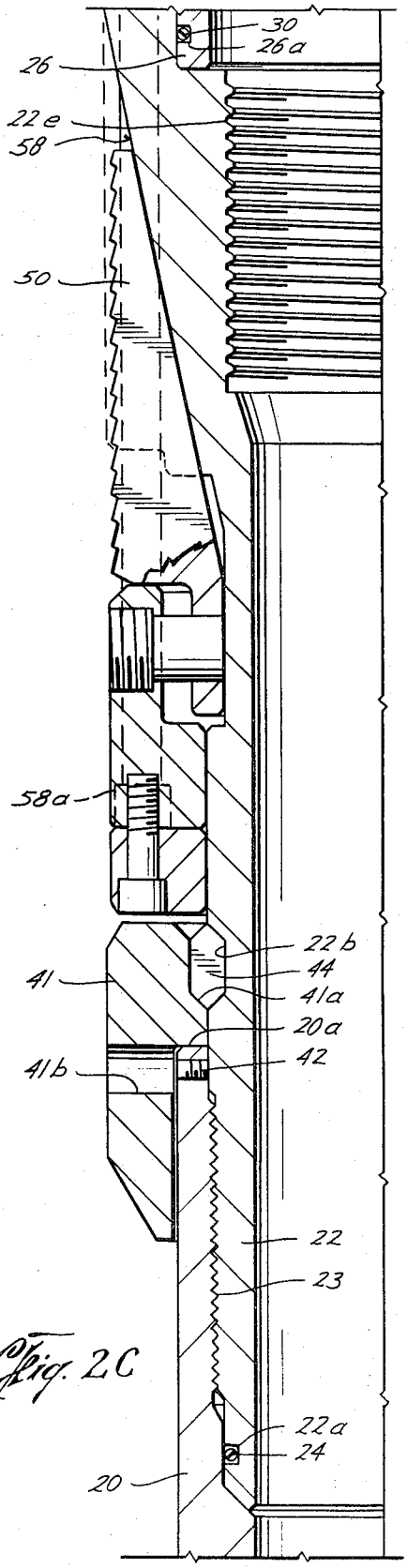

The subsurface tubing hanger STH is illustrated from top to bottom in the condition going into the well W in FIGS. 2A, 2B and 2C. The lower tubular housing portion 20 (FIG. 2C) of the subsurface tubing hanger is connected to the well tubing WT below the subsurface tubing hanger STH with any known type of tubing threaded connection (not illustrated). The tubular member 20 is threadedly connected with upwardly extending intermediate housing member 22 by threaded engagement at 23. An O-ring 24 secured in a groove **22*a* formed in the upwardly extending housing member 22 prevents leakage of fluid along the threaded engagement 23** in the usual manner.

The tubular member 22 is secured at its upper end (FIG. 2B) with another tubing hanger housing forming tubular member 26 by threaded engagement at 28. An O-ring 30 (FIG. 2C) in a recess or groove **26*a* formed on the tubular member 26 prevents leakage of fluid along threaded engagement 28. The housing member 26 extends upwardly until it threadedly engages with detachable tubing hanger upper housing member 32 by left handed threaded engagement at 34 (FIG. 2A**).

Figure 3A:
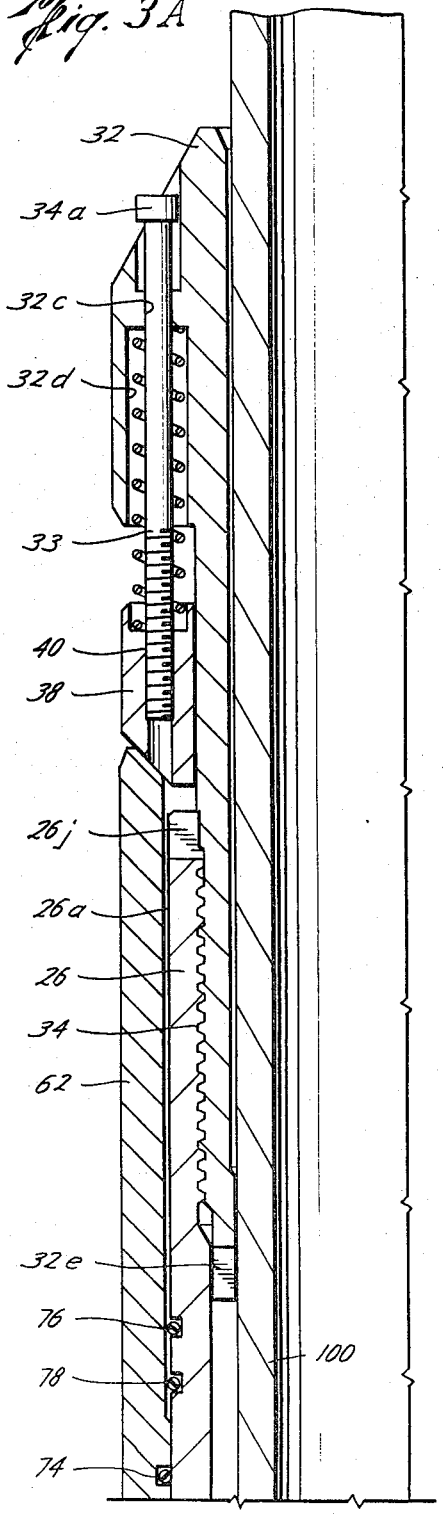
FIGS. 3A, 3B and 3C are similar to FIGS. 2A, 2B and 2C, respectively, but illustrating the subsurface tubing hanger apparatus in the condition operably installed in the well.

The upper housing member 32 continues upwardly to form an upwardly facing annular shoulder **32*a* (FIG. 2A) which terminates the tubing hanger housing. An outwardly projecting collar 32*b* is formed adjacent the upper portion of the member 32 to provide a clutch housing means. The collar 32*b* is provided with a plurality of equi-circumferentially spaced openings therethrough, generally indicated as 32*c*, which receive bolt members 33 therein. The bolt 33 is provided with the bolt head 33*a* for maintaining the clutch bolt 33 within the opening 32*c* and providing a lower stop for the bolt 33. Secured to the lower portion of each of the plurality of bolt members 33 is a clutch ring 38 which is secured to the bolt members 33 by threaded engagement at 40 in the usual manner. A spring 42 contained within the larger diameter portion 32*d* of each of the bolt openings 32*c* engages the clutch ring 38 for urging the clutch member 38 downwardly. The clutch ring 38 is provided with downwardly extending lugs which engage a slot 26*b* (FIG. 3A) formed in the upper portion of the housing sleeve 26 and the outer portion of the tubing hanger STH for imparting any rotational movement of the housing member 32 to the housing member 26 outer portion of the tubing hanger STH. Prior to setting the tubing hanger STH, the clutch ring 38 is in the engaged position illustrated in FIG. 2A and the well tubing WT may be rotated during installation of the packer PP without actuating the tubing hanger STH or disengaging left handed thread 34. When the clutch ring 38 is disengaged, as illustrated in FIG. 3A, rotation of housing member 32 is not transmitted to the housing member 26** outer portion of the tubing hanger STH.

As best illustrated in FIG. 2C, a lower slip support ring 41 is secured to the housing sleeve 22 by engagement with an upper annular shoulder **20*a* formed by the lower housing sleeve 20. A gapped or split expansible detent ring 44 secured in a recess 22*b* of the member 22 engages the upwardly facing shoulder 41*a* for securing the support member 41 from upward movement. The gapped or split detent ring 44 is installed and the ring 41 secured by make-up of the threaded engagement at 23 for securing the support ring 41 to the housing. An opening 41*b* is provided through the support ring 41 to enable the tightening of set screw 42 to prevent inadvertent disengagement of the threaded engagement at 23**.

Figure 3B:
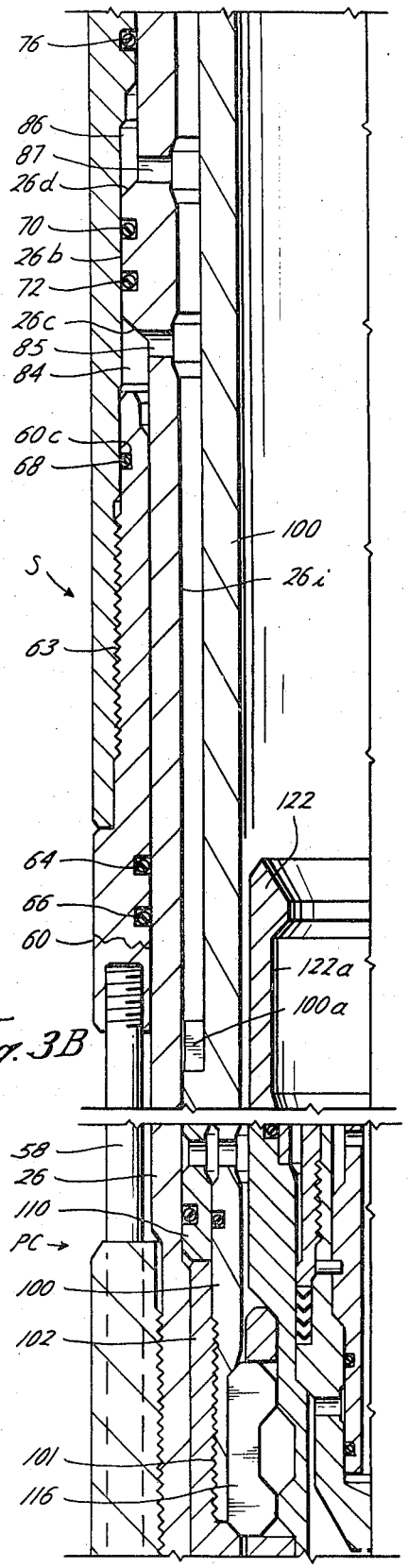
Figure 3C:
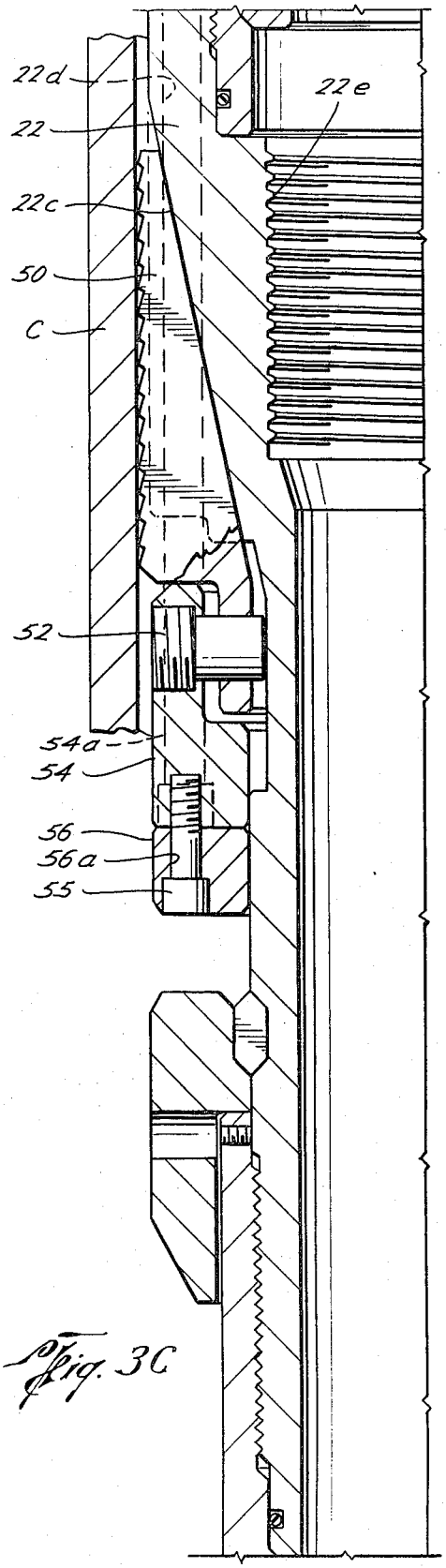

Disposed outwardly of the subsurface tubing hanger between the clutch ring 38 (FIG. 2A) and the fixed lower support ring 42 (FIG. 2C) is the tubing hanger slip means which are movable relative to the housing for securing the subsurface tubing hanger in the well. A plurality of movable slips 50 (FIG. 2C) are disposed adjacent tapered outer surface **22*c* of the housing member 22 above the support ring 41. The slips 50 are moved radially outwardly by longitudinally movement along the surface 22*c* to engage the casing C for securing the subsurface tubing hanger STH with the casing C in the known manner as illustrated in FIG. 3C. The replaceable slips 50 are secured by slip retainer pins 52 to slip holder 54. Disposed below the slip holder 54 is a slip support ring 56 which is secured to the slip holder 54 by suitable means such as bolts 55. The slip holder 54 is provided with a plurality of equi-circumferential spaced openings 54*a*, illustrated in phantom in FIG. 3C, through which slip operating rods of bolts 58 extend upwardly through a plurality of aligned equi-circumferentially spaced openings 22*d* formed through the housing member 22 between the slips 50. As the bolts 58 are moved upwardly relative to the housing the slips 50 are moved upwardly for radially expanding against the casing C by tapered surface 22*c*. The slip retainer ring 56 holds bolt heads 58*a* from movement from the slip holders 54**.

The bolts 58 are secured at their upper end with the hydraulic setting means for pulling the bolts 58 and slips 50 upwardly. The hydraulic setting means include a movably lower setting member 60 that is secured to the upper setting member 62 by threaded engagement at 63. As illustrated in FIG. 3B a pair of O-rings 64 and 66 are carried in recesses **60*a* and 60*b* of the lower setting member 60 for sealingly engaging with the outer surface 26*a* of the housing member 26. An O-ring 68 carried in recess 60*c* of the member 60 prevents leakage along threaded engagement 63**.

Formed on the outer surface **26*a* of the housing member 26 is an outwardly extending annular collar 26*b* forming a downwardly facing annular shoulder 26*c*** and an upwardly facing annular shoulder 26*d*. A pair of recesses 26*e* and 26*f* carry O-rings 70 and 72, respectively, for sealing with the upper hydraulic setting sleeve 62. Above the collar 26*b* the upper setting sleeve 62 is provided with a pair of annular recesses 62*a* and 62*b* which receive sealing O-rings 74 and 76, respectively, for sealing with the housing member 26. Above the O-rings 74 and 76 are a pair of spaced grooves 26*g* and 26*h* formed in the housing member 26 for carrying the sealing O-rings 76 and 78 for also effecting a seal between the housing member 26 and the upper actuator sleeve 62.

As illustrated in FIG. 3*b*, the O-rings 72, 68 and 64 define an expansible chamber referenced as 84 in which fluid pressure therein will urge downwardly on the setting sleeve 60 over an annular pressure responsive area between the seals 64 and 72 for urging the setting mechanism downwardly and maintaining the slips 50 in the retracted position.

Disposed above the collar 26*b* is an expansible chamber designated 86 defined by the O-rings 70 and 76. Fluid pressure in the chamber 86 will urge upwardly on the annular pressure responsive area between the seals 70 and 76 for urging the upper setting sleeve 62 upwardly and ultimately through the lower setting sleeve 60 and the bolts 58 for urging the slips 50 upwardly along the tapered surface 22*c* for setting the slips 50 in the usual manner.

The lower pressure responsive chamber 84 communicates with the bore of the well tubing through a port 85 formed in the member 26 while the fluid responsive chamber 86 communicates through a similar port 87.

It should be noted that the pressure responsive area of chamber 86 urging the slips upwardly is less than the pressure responsive area in the chamber 84 for moving the setting mechanism downwardly and maintaining the slips in the retracted position. Should the slips inadvertently move during installation it is only necessary to pressure up the bore of the tubing WT for urging downwardly on the setting mechanism for retracting the slips 50 even though both pressure responsive chambers 84 and 86 will be exposed to pressure in the bore of the well tubing WT. The advantage of the larger pressure area of the chamber 84 is that it enables circulation through the well tubing WT during installation if desired by the operator without the risk of premature setting of the tubing hanger STH.

The inner surface 26*i* of the housing member 26 is provided with a polish surface for sealing with a stinger means, generally designated S, which is removably disposed in the bore of the housing member 26. The stinger S includes a tubular stinger body 100 that is connected at its upper end with well tubing WT, usually a flow coupling (not illustrated) by threaded engagement in the usual manner. The tubular stinger 100 extends downwardly from the flow coupling below the safety valve SSV to threaded engagement at 101 with a packing and port retainer ring 102 (FIG. 3B). The retainer ring 102 secures chevron packing 108 and port ring 110 on the outer surface of the stinger 100. The chevron packing 108 effects a movable pressure seal between the stinger 100 and the polish bore 26*m* of the tubing hanger housing member 26. When going in the hole the stinger 100 is in the position illustrated in FIGS. 2A and 2B with fluid communicating ports 110*a* and 100*a* aligned with and communicating with the port 87 to the setting expansible chamber 86 for enabling fluid communication from the bore of the stinger 100 to the chamber 86. The ports 110*b* and 100*b* are aligned with and in communication with port 85 of the expansible chamber 84 for enabling communication between the bore of the stinger 100 and the expansible chamber 84. The stinger 100 is provided with upwardly facing lugs 100*a* (FIG. 3B) for receiving therebetween corresponding downwardly facing lugs 32*e* on the housing sleeve 32 for imparting rotational movement of the stinger S to the sleeve 32 and through clutch 38 to sleeves 62 and 26. This enables the apparatus A to be rotated during installation without risk of inadvertent disengagement of left handed thread 34.

After the tubing hanger STH is set the stinger 100 is moved to the lower position in FIG. 3B which isolates expansible chambers 84 and 86 from pressure in the well tubing with concave packing 108 which is moved below port 85. This isolates the hydraulic setting mechanism from well fluid pressure and eliminates the associated seals from serving as potential leak points or passages. In addition, the downward travel of the stinger 100 releases the downwardly extending clutch lugs 32*e* (FIG. 3A) of the upper hanger housing member from corresponding recesses 100*a* (FIG. 3B) in the stinger 100 to enable rotation of the stinger 100 and well tubing WT above the set tubing hanger STH if desired.

When setting members 60 and 62 are moved to the upper position (FIGS. 3A and 3B) and the tubing hanger STH is set, the clutch ring 38 is disengaged from the clutch shoulder 26*j* of the housing member 26. Thereafter, right hand rotation of the well tubing WT from the surface after engaging lugs 32*e* and 100*a* by lifting the stinger 100 will effect relative rotation of the square left hand threads 34. Such disengagement will release the upper portion of the well tubing WT from the subsurface tubing hanger STH and thereby allow replacement of the full opening subsurface safety valve SSV without disturbing the major portion of the well tubing WT which is supported by the tubing hanger STH.

Upon the disengagement of the thread 34, the stinger 100 will carry the upper tubing hanger housing member 32 as well as the clutch ring 38 back to the platform P. The housing member 32 and clutch ring 38 may then be removed and stored. When reinstalling the stinger 100 in the set tubing hanger STH the holddown means SJ is employed to secure and maintain the stinger 100 in the hanger STH.

As is illustrated in FIG. 2B, a plug catcher, generally designated PC, is secured in an internal recess 100*b* of the stinger 100 when installing the subsurface tubing hanger STH. The plug catcher is partially illustrated in FIG. 2B and is illustrated in greater detail in FIG. 14. The purpose of the plug catcher PC is to receive a setting plug, generally designated SP, therein for providing unequal fluid pressure in the expansible chambers 86 and 84 for effecting setting of the subsurface tubing hanger STH and thereafter enabling retrieval from the bore of the stinger 100 in order to enable full opening flow through the subsurface tubing hanger STH.

Figure 14:
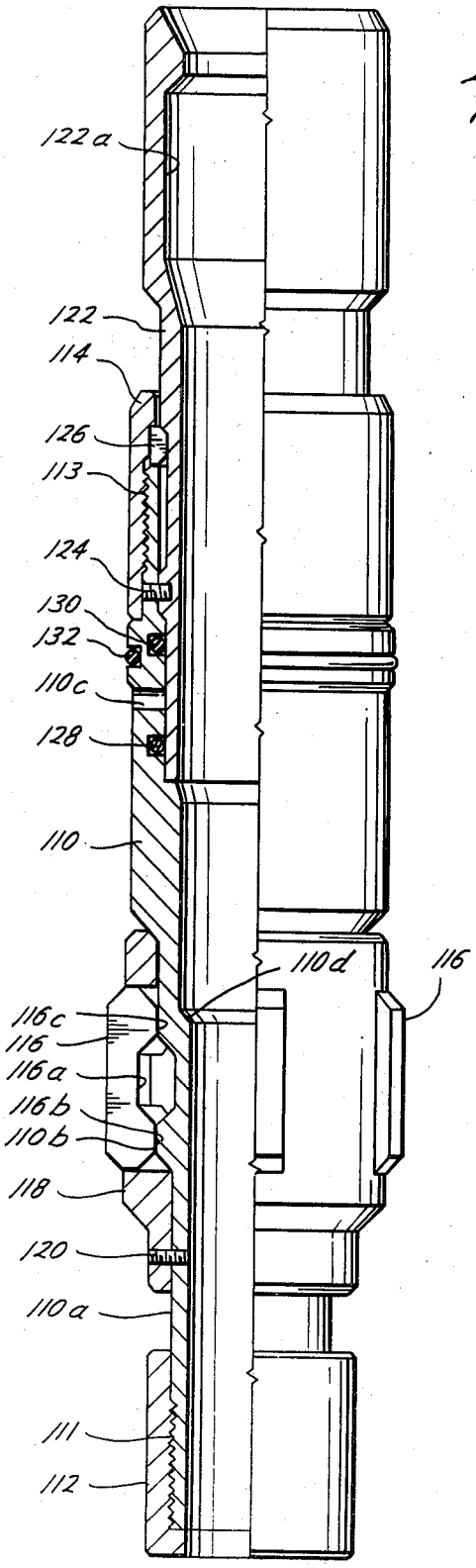
FIG. 14 is a side view, partially in section of the plug catcher apparatus of the present invention.

As is best illustrated in FIG. 14, the plug catcher PC includes an elongated tubular body 110 having a lower latch dog retainer 112 secured thereto by threaded engagement at 111. The body 110 is also secured to an upper fishing neck retainer 114 by threaded engagement at 113. A plurality of latch dogs or securing members 116 are movably mounted on the outer surface 110*a* of the body 110. The latch dogs 116 are provided with a central release recess 116a formed between inner latching surfaces 116b and 116c. The latch dog 116 is mounted on the outer surface 110a by the retainer member 118 which is secured to the body 110 by shear pin 120. The latch dogs 116 are mounted in a corresponding plurality of windows 118a formed in the retainer member 118. When it is desired to release the latch dogs 116 from the radially expanded position illustrated in FIG. 14 to enable their movement out of the recess 100b, the shear pin 120 is sheared enabling the retainer 118 to move toward the retainer ring 112 with the latch dog 116 and enable the body 110 to move upwardly relative thereto until latching surface 110b engages latching surface 116a. This enables the latch dogs 116 to move radially inwardly by the taper of recess 100b where they will pass upwardly through the bore of the stinger 100 for removal from the set subsurface tubing hanger STH.

To enable such upward movement for shearing pin 120 the plug catcher is provided with an inside tubular fishing neck 122 having the inner annular recess 122a that is adapted to be releasably engaged by the fishing tool. After such engagement, the fishing neck 122 is jarred upwardly to effect failure of shear pin 124 which fixes the tubular fishing member 122 with the body 110 and which occurs before pin 120 is sheared. After shearing of the member 124 the fishing neck 122 will move upwardly until engagement with the securing detent 126 which is contained by the upper securing sleeve 114.

This limited upward movement of the fishing neck 122 relative to the body 110 will uncover flow port 110c for enabling fluid communication therethrough as the plug catcher moves upwardly through the stinger 100 in the well tubing WT to the platform P. A pair of O-rings 128 and 130 prevent fluid communication between the port 110c and the bore of the plug catcher by sealingly engaging between the body member 110 and the fishing neck 122 on either side of the port 110c prior to shearing pin 124. An O-ring 132 carried on the outer surface 110a effects a fluid seal with stinger inside surface 26i between the ports 100a and 100b for separating expansible chambers 86 and 84. The limited upward movement of the fishing neck 122 relative to the body 110, when terminated, will effect shearing of pin 120 to release the retainer 118. As previously disclosed this releases the latch dogs 116 for releasing the plug catcher PC from the set tubing hanger STH.

Figure 15:
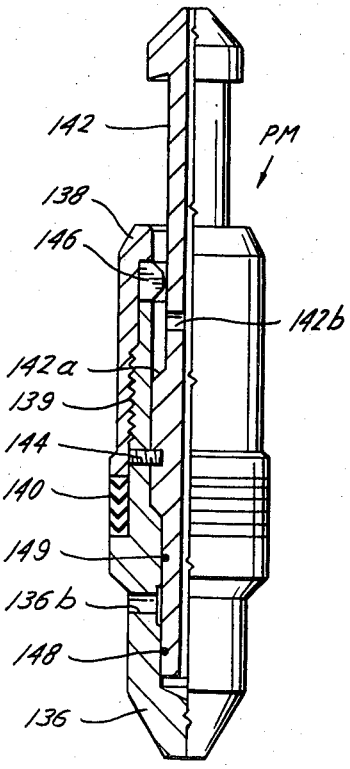
FIG. 15 is a side view, partially in section of the setting plug apparatus of the present invention.

The plug catcher body 110 is provided with an upwardly facing annular shoulder 110d (FIG. 2B) which provides a stop or no-go for the setting or operating plug means, generally designated SP, which is illustrated in greater detail in FIG. 15.

The setting plug SP includes a main body portion 136 threadedly secured to an upper retainer sleeve 138 by threaded engagement at 139. The body plug member 136 is provided with a downwardly facing tapered annular shoulder 136a adapted to engage the seat 110d of the plug catcher PC for blocking further downward movement of the setting plug SP. A chevron packing 140 mounted on the plug body 136 below the upper retainer 138 seals the setting plug SP with the plug catcher. When the setting plug SP is installed in the plug catcher PC, O-rings 132, 130, 128 and chevron packing 140 serve to block fluid communication of the fluid pressure in the bore of the well tubing WT above the tubing hanger STH from the pressure in the bore of the well tubing WT below the tubing hanger. With the establishment of this sealing arrangement, increased fluid pressure in the bore of the well tubing WT above the setting plug SP will communicate the increased pressure through ports 100a, 110a and 87 into the upper expansible chamber 86 for overcoming the greater pressure area in the expansible chamber 84 for setting the slips 50. Thus whenever it is desired to set the tubing hanger the setting plug SP is dropped into the plug catcher PC and the pressure in the bore of the well tubing is increased from the platform P for setting the tubing hanger STH.

The plug means PM is provided with a fishing neck 142 that is secured to the plug body 136 by a shear pin 144. When it is desired to retrieve the setting plug SP without the plug catcher PC the fishing neck 142 will be engaged for pulling upwardly to shear the pin 144 and enable upward movement of the fishing neck relative to the plug body 136 until the upwardly facing annular shoulder 142a on the fishing neck engages the retainer ring 146 secured by the upper retainer member 138. The relative upward movement of the fishing neck 142 will uncover port 136b by moving O-rings 148 and 149 above the port 136b to prevent swabbing of the bore of the well tubing WT during retrieval. A port 142b is also provided through the tubular fishing neck 142 for enabling equalization of fluid pressure as the setting plug SP moves upwardly to the surface.

Should the subsurface tubing hanger STH be set at an incorrect location, an outside fishing tool may be run down into the stinger for engaging the fishing neck 142 and unseating the shoulder 136a from the plug catcher PC. Then by pressuring the bore of the well tubing WT from above and supporting the well tubing WT with the derrick D the hanger STH may be released. The pressuring of the bore of the well tubing WT will, of course, increase fluid pressure in the chamber 84 as well as the chamber 86 for retracting the slips 50 and releasing the hanger STH. This will enable movement of the tubing hanger STH to the proper location where the plug means PM may be reseated for setting the tubing hanger STH at the proper location.

Once the tubing hanger STH is set properly at the desired location, it becomes necessary to retrieve the plug catcher PC and setting plug SP from the hanger STH. This is done with the retrieving tool, generally designated RT, illustrated in FIG. 4 which is connected to a wireline WL having a number of sinker bars mounted directly above the retrieving tool RT in the usual manner. The retrieving tool RT includes a lower tubular body 150, a movable inner control member 152 and an attaching means, generally designated 154. The attaching means 154 include the upper tubular sleeve 156 having thread means 156a formed therein for attachment to the sinker bars and wireline. The attaching sleeve 156 is threadedly secured at 157 to the attaching retainer sleeve 158.

The lower tubular body 150 is provided with a plurality of equi-circumferentially spaced windows 150a in which are disposed a corresponding plurality of movable latch dogs 160. The latch dogs 160 are movable radially inwardly from the radially extended position illustrated in FIG. 4 when the movable inner member 152 moves longitudinally relative to the latch dogs for moving the outwardly projecting collars 152a and 152b from under the lock extensions 160a and 160b, respectively, of the latch collar 160. A biasing spring 162 urges the inner control member 152 upward relative to the lower tubular body 150 for maintaining the latch dogs 160 in the radially extended position. Movement of the inner member 152 either upwardly or downwardly relative to the latch dogs 160 will enable their inward radial movement in the manner to be described more fully hereinafter. The lower tubular body 150 is provided with an outer annular collar 150*b* which serves as a stop shoulder for engaging the fishing neck 122 of the plug catcher PC for enabling the latch dogs 160 to be properly positioned adjacent the recesses 122*a* wherein they can be radially expanded for securing the retrieving tool RT with the plug catcher PC in the manner illustrated in FIG. 4.

As the latch dogs 160 engage the fishing neck 122 of the plug catcher PC, the weight of the sinker bars transmitted to the control member 152 will overcome the urging of spring 162 and enable the control member to move downwardly relative to latch dogs 160. Such movement will enable the latch dogs 160 to move radially inwardly until shoulder 150*b* engages the fishing neck 122. At that time the latch dogs 160 will be adjacent recess 122*a*. As soon as the weight of the sinker bars is supported by the wireline WL, the spring 163 will force the control member 152 to move upwardly for forcing the latch dogs 160 radially outwardly and securing them in that condition.

Above the stop shoulder 150*b*, a plurality of equicircumferentially spaced windows 150*c* formed in the lower tubular body 150 for receiving a corresponding plurality of securing latch dogs 160 therein. The dogs 160 are partially received in recesses 152*c* of the member 152 while a securing sleeve 166 maintains the dogs 160 in the recess 152*c* for defining an upward movement stop for the central member 152 relative to the lower tubular body 15). The sleeve 166 is secured to the lower tubular member 150 by a shear pin 168 for purposes to be described more fully hereinafter.

Above the latch dogs 160 the lower tubular body 150 is provided with a plurality of elongated slots defined by an upper stop shoulder 150*d* and a lower stop shoulder 150*e*. A guide and keeper bolt 170 is received in each of such slots and secured to the central member 152 for serving as a longitudinal movement guide and for securing the body 150 with the control member 152 under certain conditions. When the shear pin 168 is sheared and the sleeve 166 is enabled to move down relative to the control member 152 to align a recess 166*a* formed in the sleeve 166. The recess 166*a* will enable the latch members 160 to move radially outwardly and enable the central member 152 to move upwardly relative to the latch dogs 160 and thereby effect their release. Disposed immediately below the upper attaching sleeve 158 is a safety ring 172 secured to the central member 152 by shear pin 174 that is sheared by downward jarring. After the shearing of shear pin 174 a detent ring 176 will limit downward movement of the sleeve 156 to the length of the recess 152*d* while serving to retain the control member 152 to the wireline WL.

In the event that the retrieving tool RT is unable to unseat the plug catcher PC, it becomes necessary to release the retrieving tool RT from the plug catcher PC. At that the time latch dogs 160 will be expanded radially outwardly into the latching recesses 122*a* of the latching sleeve 122 of the plug catcher PC. To effect release of the latch dogs 160, the sinker bars are used in conjunction with a downward jar to shear pin 174 and enable the upper sleeves 158 and 156 to move downwardly until the keeper 176 engages the lower annular portion of the recess 152*d*. Before engaging the limits of the recess 152*d* the sleeve 158 engages the sleeve 166 for shearing the shear pin 168 and enabling the locking sleeve 166 to move downwardly. This movement places the recess 166*a* adjacent the latch 164 which then moves radially outwardly and enables the central member 152 to move upward relative to the latch dogs 160. With such upward movement the latch dogs 160 are free to move inwardly and out of the recess 122*a*. The guide and keeper member 170 in the slot will engage the shoulder 150*d* for pulling the tubular body 150 upwardly.

When it becomes necessary to retrieve the subsurface tubing hanger STH, the lower well tubing WT or packer pp from the well W, the stinger 100 is released and retrieved back to the platform P. A work string (not illustrated) is then lowered down the casing C. The work string is provided on its lower end with a thread adapted to engage and make up with helical thread 22*e* (FIG. 2C). After make-up with the thread 22*e* the work string may be used to elevate the hanger housing member 22 relative to the set slips 50 thereby effecting their release from the casing C. The positive make-up also enables rotation and reciprocation of the well tubing WT below the hanger STH that may be needed to release the packer PP.

THE SUBSURFACE SAFETY VALVE

The full opening surface controlled subsurface safety valve SSV of the present invention is illustrated in detail from top to bottom in FIGS. 5A–5D. The subsurface safety valve SSV is connected in the well tubing WT above the subsurface tubing hanger STH and forms a tubular housing portion of the well tubing WT. The stinger 100 is secured to well tubing WT that is in turn secured to the lower portion of the subsurface safety valve SSV for directing flow of the well fluids upwardly through the portion of the well tubing WT formed by the safety valve housing, generally designated SSVH. Operably disposed within the safety valve housing SSVH (FIG. 5C) is a full opening flow control element, generally designated SSVB, and operator means, generally designated SSVO, for effecting movement of the closure element SSV to and from the open and closed positions in response to control signals communicated from the platform P to the subsurface safety valve SSV through control fluid conduits. It is to be understood that other full opening safety valves may be used with the safety system of the present invention. For example, full opening subsurface safety valves such as disclosed in one of the following of my U.S. Pat. Nos. may be employed with the present invention:

3,744,564
3,750,751
3,762,471
3,901,321
3,993,136

The subsurface safety valve housing SSVH includes an upper housing member 200 (FIG. 5A) that is threadedly connected to the well tubing WT above the subsurface safety valve SSV in the usual manner. The upper housing member 200 is secured to the control fluid housing member 202 by threaded engagement at 201 while an O-ring 204 blocks leakage of fluid along threaded engagement 201. A second O-ring 206 blocks leakage of fluid between the two members at a location below the O-ring 204 for a control fluid separation purpose to be described more fully hereinafter.

The lower portion of the control fluid housing 202 threadedly engages an intermediate housing connecting section 208 by threaded engagement at 207 with an O-ring 210 blocking leakage of fluid along the threaded engagement at 207. The lower portion of the intermediate connecting member 208 is threadedly engaged with a ball housing section 212 by threaded engagement at 211 with an O-ring 214 preventing leakage of fluid along the threaded engagement at 211 (FIG. 5B).

The ball housing section 212 threadedly engages at 216 with the lower housing extension 218 (FIG. 5C) which is in turn connected to the stinger 100. Preferably, a blast joint (not illustrated) is disposed between the stinger 100 and the lower housing section 218. An O-ring 219 prevents leakage along threaded engagement at 216.

Figure 10:
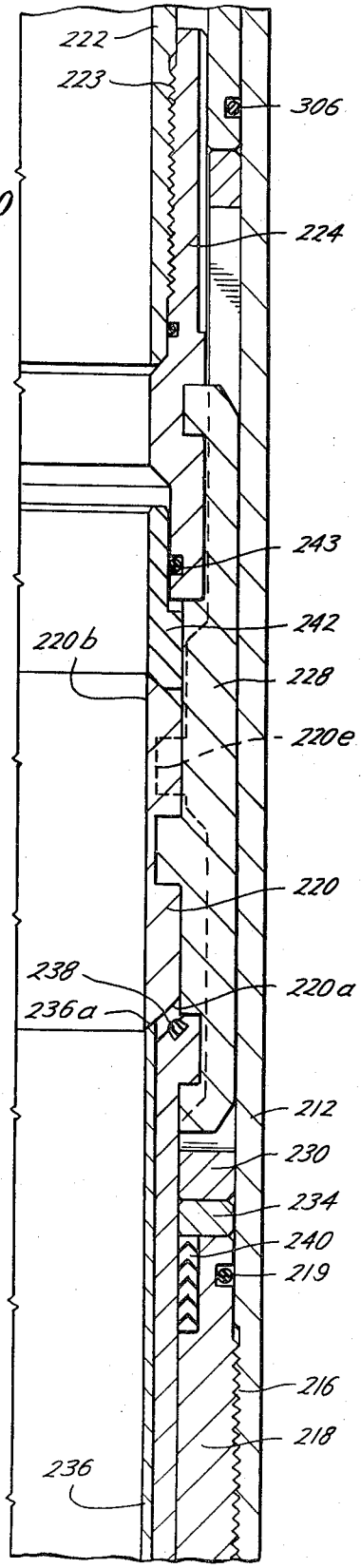
FIG. 10 is a side view, similar to FIG. 5C, but illustrating the rotatable ball element moved to the open position.

The flow control element SSVB is mounted within housing member 212 for movement from a closed position (FIG. 5C) for blocking flow of fluid through the bore of the housing SSVH to an open position (FIG. 10). In moving from the closed position to the open position the ball also moves longitudinally within the housing 212 from an upper or closed position to the lower open position. As will be described in greater detail, such longitudinal motion rotates a ball element 220 having a spherical outer surface **220*a* to align a full opening flow port 220*b* formed therethrough with the flow opening through the housing SSVH. The ball element 220 is formed with a pair of parallel chordal flats 220*c* having an elongated concentric recess 220*d* and an eccentric slot or recess 220*e* for receiving a fixed eccentric pin to rotate the ball 220**.

Figure 5A:
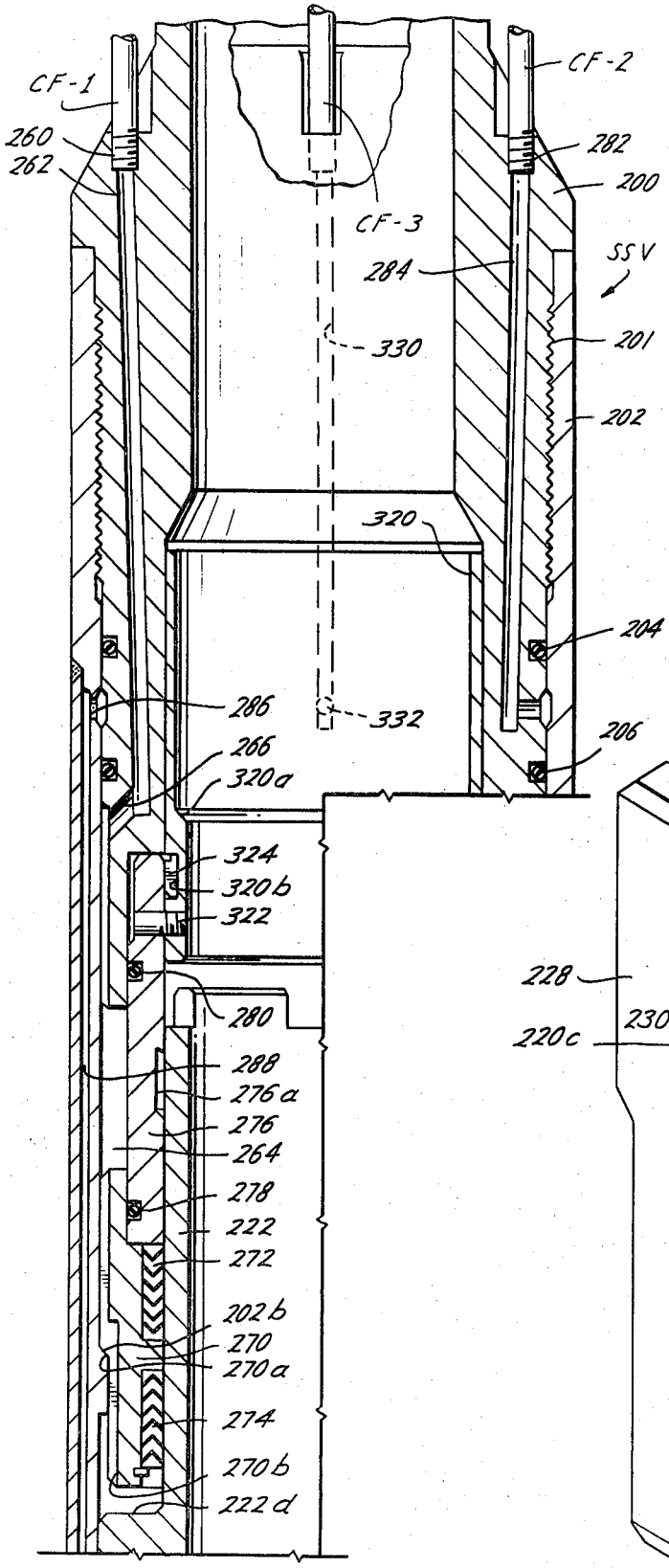
Figure 5C:
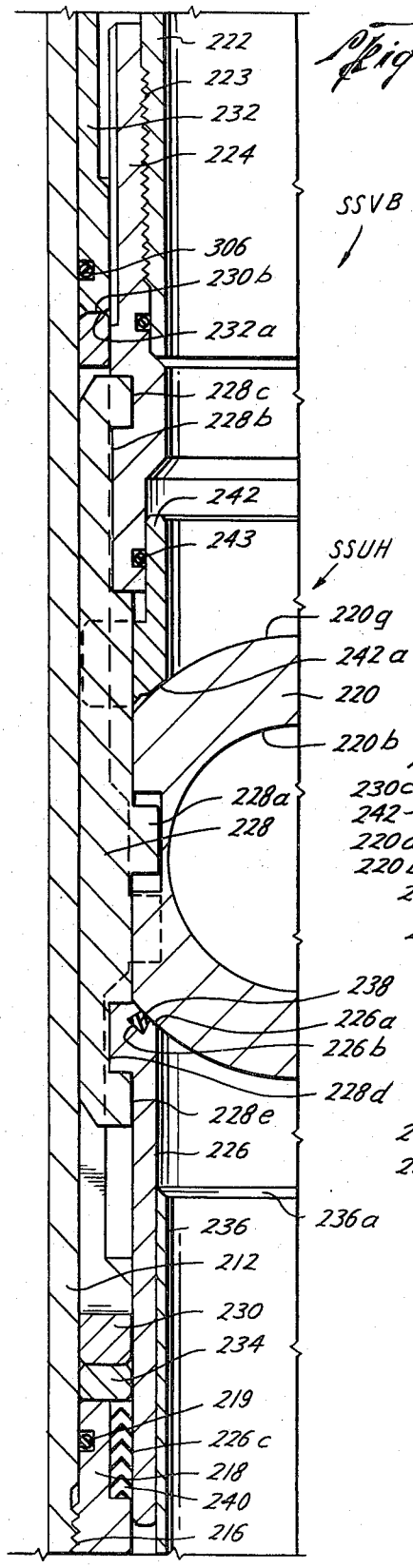

Disposed within the safety valve housing SSVH is the valve operator means SSVO for effecting movement of the ball 220 to and from the open and closed positions. The operator means SSVO includes an upper tubular sleeve 222 that is secured to the upper connecting sleeve 224 by threaded engagement at 223 (FIG. 5C). Disposed within the housing sleeve 212 below the ball 220 is a lower operator sleeve 226. The sleeves 224 and 226 are connected by ball support links 228 that are disposed on opposite sides of the ball 220.

Figure 6:
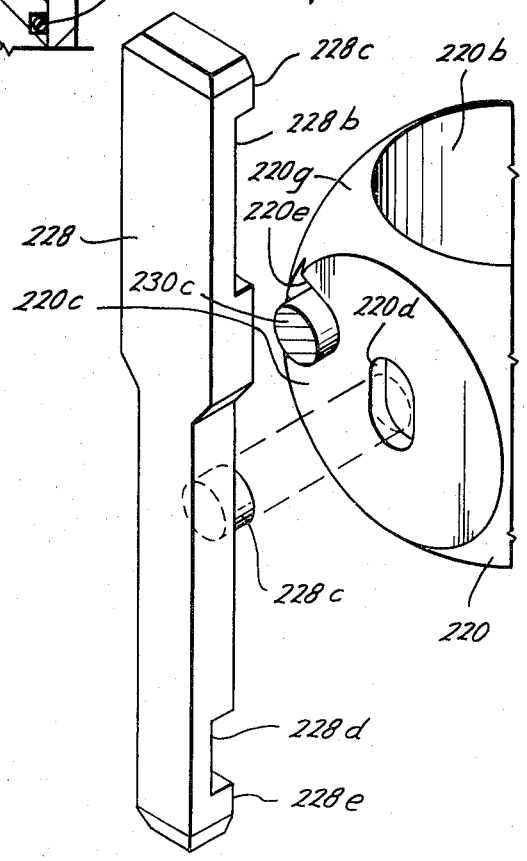
FIG. 6 is a perspective view of a rotatable ball apparatus and its mounting arrangement.

As illustrated in FIG. 6, each of the ball support members 228 have inwardly projecting ball support pins or lugs **228*a* which are received in the elongated central slot 220*d* of the ball 220. The elongated slot 220*d* enables limited longitudinal movement of the ball relative to the concentric support lugs 228*a* for a purpose to be disclosed more fully hereinafter. The ball support member 228 is provided with an upper recess 228*b* and upper inward projections 228*c* which secure the support members 228 with the movable upper operator sleeve 224. A lower recess 228*d* and lower inward extension 228*e* secure the ball support members 228 with the lower operator sleeve 226. The ball support members 228 positively connect the operator sleeves 224 and 226** to assure longitudinal movement together as a single unit for a purpose to be described more fully hereinafter.

The ball support members 228 are movably mounted with a split ball cage member 230 having slots **230*a* for movably receiving therein the ball support members 228. The split ball cage members 230 are identical, with an exception to be described more fully hereinafter, and are secured in the subsurface safety valve housing SSVH against longitudinal movement. The ball cage members 230 are provided with an upper annular surface 230*b* which engages the lower annular shoulder 232*a* of the spacing and sealing member 232 (FIG. 5C). The upper annular shoulder 232*b* of the member 232 engages the housing transition sleeve 208 for blocking upward movement of the ball cage 230 in the subsurface safety valve housing SSVH. Downward movement of the ball cage member 230 is blocked by a spacer ring 234 mounted above the housing member 218. While the split ball cage members 230 are secured in the subsurface safety valve housing SSVH against longitudinal movement, the ball support members 228 and ball 220 are free to move longitudinally in slots 230*a***.

The ball cage members 230 have eccentric pins **230*c* mounted thereon on a common axis and which are the differences between the mirror images of the split ring members 230. The eccentric pins 230*c* are, of course, fixed with the ball cage members 230 and are received within the eccentric slots 220*e* of the ball for effecting rotation of the ball 220** during its longitudinal movement. Such rotation is described in greater detail in my aforementioned patents as well as in Knox U.S. Pat. No. 3,035,808 and which is also assigned to the assignee of the present invention.

Figure 5D:
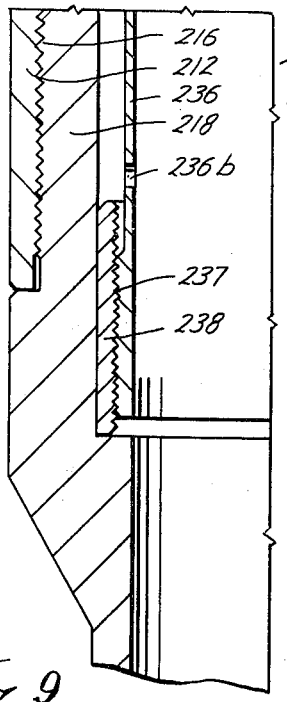

Mounted within the lower operating sleeve 226 is a fixed ball movement limiting sleeve 236 having an upwardly facing arcuate ball engaging shoulder **236*a* for engaging the ball 220 to limit the longitudinal and thereby rotational movement of the ball 220 to the lower position (see FIG. 10). As is illustrated in FIG. 5D, the movement limiting sleeve 236 is secured to the collar member 238 by threaded engageable adjustment means 237. This provides an adjustment means for assuring that the ball bore 220*b* is fully aligned with the bore of the well tubing WT to provide the full bore opening. In addition, a port 236*b* is provided above the locating collar 238 to enable venting or filling of the expansible chamber below the lower operator member 226** as it moves to and from the upper and lower positions.

The lower operator sleeve 226 forms an upwardly facing arcuate surface **226*a* for providing a primary metal-to-metal seal with the ball 220. The primary sealing surface 226*a* has an annular dove-tail recess formed thereon for receiving a resilient ring or soft seat 238 which also engages the outer spherical surface 220*a* of the ball 200 for effecting a secondary or backup seal. The outer surface 226*c* of the lower operator 226 sealingly engages a chevron packing 240 carried by housing member 218 below spacer ring 234 for blocking the leakage of fluid therebetween. When the seat 226*a* and molded seal 238 carried in the recess 226*b* sealingly engages the ball 220 and the chevron packing 240 sealingly engages the outer surface 226*c*, the member 226 will cooperate with the closed ball 220 to provide a first flow passage blocking means through the subsurface safety valve SSV. Fluid pressure below the closed ball 220 urges the lower operator 226 upwardly for enhancing the sealing contact pressure with the ball 220**.

The second flow passage blocking means includes an upper seat 242 having a downwardly facing arcuate sealing surface **242*a* for sealingly engaging with the ball 220. The surface 242*a* contacts the ball 220 within the sealing contact of the O-ring 243 carried by the operator member 224 for ensuring that a pressure differential area for urging upwardly on the upper seat 242 exists. By sealing in this manner, the fluid pressure passed by the first sealing means will tend to urge the upper seat 242 upwardly away from the ball 220 until it is trapped by the downwardly facing annular surfaces 230*c* (FIG. 8) of the split ball cage members 230. The purpose of the sealing of the O-ring 243 and the arcuate surface 242*a* is to maintain the seat 242 in an upper position relative to the ball 220 as the ball moves to the open position for spacing therebetween to minimize friction between the ball 220 and the seat 242 and to provide an annular equalizing means for any pressure differential in the well tubing across the closed ball 220**.

Figure 8:
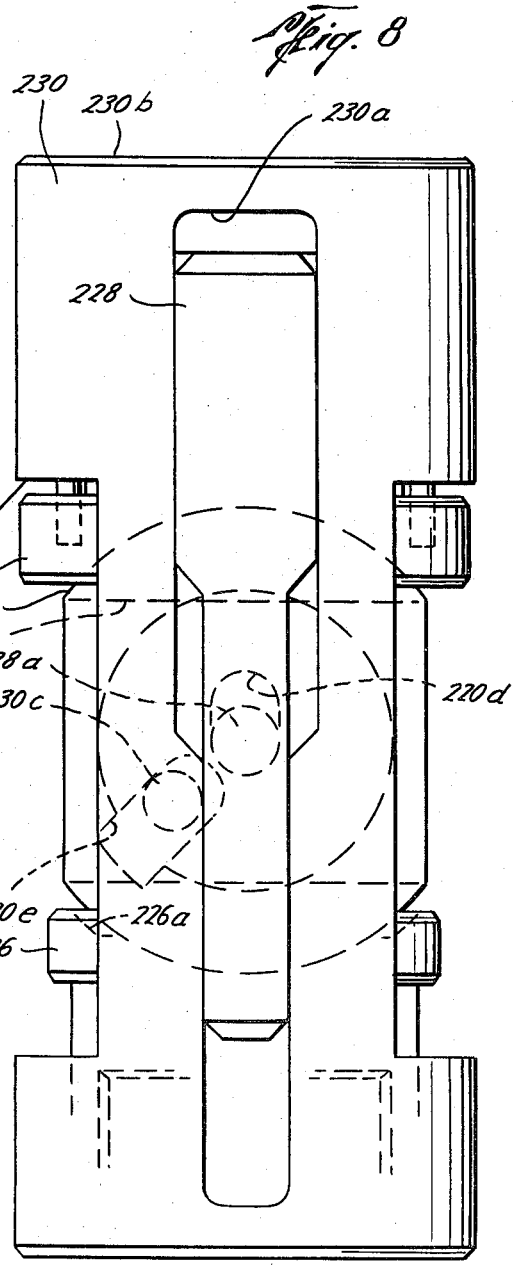
Figure 9:
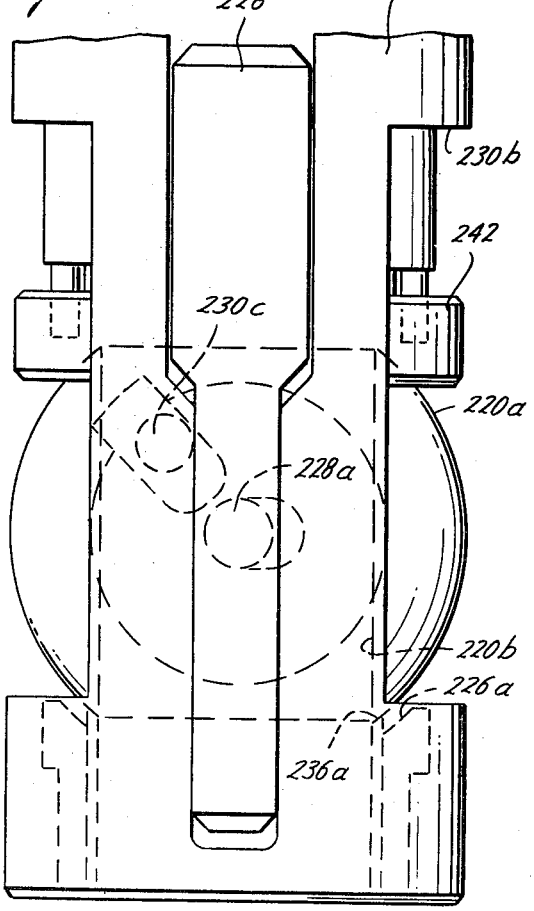

This sequence of seal spacing and ball rotation is best illustrated in FIGS. 7, 8 and 9 which are sequence views of the ball moving from the closed position of FIG. 7 to the open position of FIG. 9. As the operator sleeve 224 commences to move downwardly the connecting links 228 move downwardly until the concentric support pins 228*a* reaches the bottom of the elongated concentric slot or opening 230*a*. At this point the lower seat 226 has been moved away from the ball 220 by link 228 and the sealing engagement by the arcuate sealing surface 226*a* as well as the bonded seal 238 is no longer sealingly engaged and fluid pressure below the ball 220 is free to move upwardly outside the ball 220 until the sealing engagement of the ball and the upper seat 242*a* where the flow remains closed since no spacing of the ball 220 from the upper seat 242*a* has occurred.

As the ball support members 228 continue to move downwardly the ball 220 is spaced from the upper seat 242*a* and the ball eccentric slot receiving the fixed eccentric pins 230*c* commence to rotate the ball 220 to the open position. The engagement of the upper seat 242 with the operator sleeve 224 will commence to move the upper seat 242 downwardly while fluid pressure tends to maintain the upper seat 242 spaced above the ball 220. The ball 220 continues to move downwardly until the outer spherical surface 220*a* engages the upwardly facing arcuate shoulder 236*a* which serves as the ball stop (FIG. 9) at which time the lower arcuate sealing surface 226*a* is spaced below the ball and from sealing engagement therewith. When the ball 220 is in the open position the eccentric pin 230*c* is disposed above the concentric pun 228*a* as opposed to being disposed below the concentric pin 228 when the ball 220 is in the closed position (FIG. 7).

When the ball 220 is in the open position the differential pressure across the upper seat 242 will equalize and the weight of the upper seat 242 will return it to sealing engagement with the ball 220. However, there can be no pressure differential buildup across the seat 242 from below as the seat 242 will remain engaged with the ball 220. If a pressure differential does occur it would only lift the seat 242 from the ball 220 for venting and equalizing any fluid pressure differential from below the ball 220. In addition, the slot 230*a* may be used to force the seat 242 back on to the ball 220 or biasing springs may be used.

FIG. 8 is partially illustrated out of the aforementioned sequence of spacing and rotating the ball 220 open in that the upper seat is illustrated as moving downwardly from the shoulder 230*b* rather than remaining in the upper limit position illustrated in FIG. 7. This was done to show the range of travel or spacing that occurs between the ball in the upper seat as the concentric pivot pins 228*a* move downwardly to engage the bottom of the slot 220*d*. Such a situation could occur in opening the valve if there was no pressure differential existing across the closed ball 220 as the weight of the upper seat 242 would be sufficient to follow the ball 220 downwardly in the absence of the pressure differential. However, it is to be understood that while such following engagement by the upper seat 242 of the ball 220 may occur, it is subject to the conditions of fluid pressure in the well when opening the subsurface safety valve SSV.

As has been disclosed, downward movement of the operator member 224 will move the ball 220 from the closed portion to the open position illustrated in FIG. 10. Likewise, upward movement of the operator 224 will move the ball 220 from the open position to the closed position. As previously disclosed herein the operator sleeve 224 is secured to the upper operator sleeve 222. Formed on the outer surface 222*a* of the operator sleeve 222 is an annular collar 222*b* forming a downwardly facing annular shoulder 222*c* and an upwardly facing annular shoulder 222*d*. A spring means 250 disposed between the shoulder 222*c* and the intermediate housing connector member 208 urges the operator sleeve 222 to the upper position for effecting closure of the ball 220.

To overcome the urging of the spring 250, control fluid pressure is supplied from the surface through control fluid conduits CF-1 and CF-2 to the valve SSV for effecting opening of the ball 220. The control fluid pressure through the control fluid conduit CF-1 is communicated in the subsurface safety valve for urging downwardly on the pressure responsive upwardly facing annular shoulder 222*d* for opening the valve. Control fluid pressure through control fluid conduit CF-2 is used to balance the hydrostatic head of control fluid pressure in CF-1 by urging on pressure responsive annular shoulder 222*d* to enable deeper setting of the valve by providing a hydrostatic balance on the valve. An O-ring 252 is carried on the annular collar 222*b* for effecting a sliding seal with an inner surface 202*a* of the control fluid housing 202 to prevent communication of the control fluid across collar 222*b*.

The normal opening control fluid conduit CF-1 threadedly engages at 260 with inlet port 262. Within the upper housing member 200 the port 262 communicates with an expansible chamber 264 disposed above the pressure responsive surface 222*d* through port 266 disposed immediately below O-ring 206. The expansible chamber 264 is defined at its upper portion by O-ring 206 and at its lower end by the O-ring 252 carried by the operator sleeve 222. Disposed within the expansible chamber 264 is a seal carrying member 270 having a downwardly facing annular shoulder 270*a* engaging an upwardly facing shoulder 202*b* located above the sliding sealing surface 202*a* of the control fluid housing member 202. An outer slot 270*b* formed in the seal member 270 enables fluid communication past the seal carrying member 270 from port 266 to the pressure responsive surface 222*d*. The seal member 270 carries a pair of annular chevron packings 272 and 274 for sealing with the operator member 222. The seal carrying member 270 is held in engagement with the annular shoulder 202*b* by a spacer lock member 276 that is secured against movement by engagement with the upper housing member 200. The spacer member 276 carries an O-ring 278 for effecting a seal between the seal member 270 and the spacer member 276 as well as an O-ring 280 for effecting a seal with the upper housing member 200. The O-rings 280 and 278 along with chevron packing 272 and 274 provide intermediate seals for the opening expansible chamber 264 for containing a control fluid pressure therein.

The balance control fluid conduit CF-2 threadedly engages the upper housing 200 at 282 for communicating with the control fluid conduit 284 which communicates between O-rings 204 and 206 through a port 286 with an elongated passageway 288 formed in the control fluid housing member 202. The passageway 288 extends downwardly below the O-ring 252 where it communicates with the area below the annular shoulder 222c through port 290 with the balance expansible chamber 292. The balance expansible chamber 292 is defined at its upper limit by the O-ring 252 while O-ring 210 and chevron packing 294 carried by the intermediate connecting member 208 seal the lower portion of the lower balancing expansible chamber 292.

Thus the control fluid pressure introduced through control fluid conduit CF-1 will enter the chamber 264 for urging the operator member 222 to move downwardly for rotating the ball 220 open. During such downward movement the hydraulic fluid in the chamber 292 will be vented back to the surface through control fluid conduit CF-2 in the usual manner.

In the illustrated embodiment control pressure fluid supplied through the control fluid conduit CF-2 will tend to urge the ball 220 to the closed position as well as performing certain other desired functions to be described more fully hereinafter. However, it should be understood that the balance control fluid conduit CF-2 could be used to effect opening rotation of the ball 220 as disclosed in my aforementioned patents.

Sometimes it becomes desirable to pump down the well tubing WT for various reasons and the capability of pumping down through a closed subsurface safety valve SSV is a very desirable feature. To accomplish this result there is provided with an expansible chamber 300 communicating with the bore of the well tubing WT for moving the ball 220 to the open position in response to the pumpdown pressure.

The expansible chamber 300 communicates with the bore of the well tubing through a port 302 formed through the operator sleeve 222 (FIG. 5B) A chevron packing 304 carried by the intermediate connecting member 208 effects a fluid seal between the intermediate connecting housing member 208 and the tubular operator member 222. The O-ring 214 prevents escape of well fluid pressure from the expansible chamber 300 along threaded engagement 211 while an O-ring 306 carried by the spacer member 232 prevents leakage of well fluid from the expansible chamber 300 between the spacer member 232 and the housing member 212.

Movably mounted on the operator member 222 below housing connector 208 is a piston ring 308 that is disposed between the spacer ring 232 and the operator 222. The piston ring 308 is provided with chevron packings 310 and 312 for slidably sealing on the operator 222 while chevron packings 314 and 316 slidably seal with the spacer member 232. When it is desired to pump down the well tubing and through the closed subsurface safety valve SSV the fluid pressure will commence to build up above the closed ball 220 and this increased pressure will be communicated into the expansible chamber 300 through the port 302. This pressure will build up across the piston ring 308 and the closed ball 220 for urging the piston ring 308 to move downwardly in response to pressure differential formed thereacross. As the piston ring 308 moves downwardly it engages the operator sleeve 224 for forcing the operator sleeve 224 downwardly and thereby rotating open the ball 220. As the fluid pressure urging the ball down is applied over a greater surface area, that is the area extending to the outer seals of the chevron packing 314 and 316 which is greater than the pressure area urging upwardly, the ball will rotate fully open and remain fully open during pumpdown operations and will not partially rotate open which could result in seat damaging cutting flow occurring around the ball 220 and seats 242 and 226.

As mentioned previously, a releasable lock means may be provided in accordance with my previously mentioned patent for releasably locking the ball in the open position to enable performance of certain well operations through the valve. In addition, a lockout means, such as illustrated in FIG. 5A may be employed. Such lockout means is similar to that disclosed in U.S. Pat. No. 2,998,077, issued Aug. 29, 1961. The lockout means includes a lockout sleeve 320 having an upwardly facing annular shoulder 320j that is engageable by a shifting tool (not illustrated) movable through the bore of the well tubing WT for seating on locking sleeve 320 and shearing the shear pin 322 for moving the sleeve 320 downwardly when the tubing WT is pressured up from above. The downward movement of the sleeve 320 will, of course, bring the sleeve 320 in engagement with the operator sleeve 222 for moving the operator sleeve 222 downward and effecting opening rotation of the ball 220. An expansible detent ring 324 carried in a recess 320b of the locking sleeve will expand radially outwardly in an annular recess 276a of the spacer member 276 for locking the sleeve 320 in the lower position and maintaining the ball 220 rotated open.

The subsurface safety valve SSV is also provided with a control fluid passageway 330 (FIG. 5A) which communicates through a port 332 with the control fluid conduit CF-2 between the O-rings 204 and 206. The control fluid conduit 330 connects through a tubing of control fluid conduit CF-3 with the safety joint SJ apparatus of the present invention for a purpose to be described more fully hereinafter.

THE HOLDDOWN AND SAFETY JOINT APPARATUS

Figure 11A:
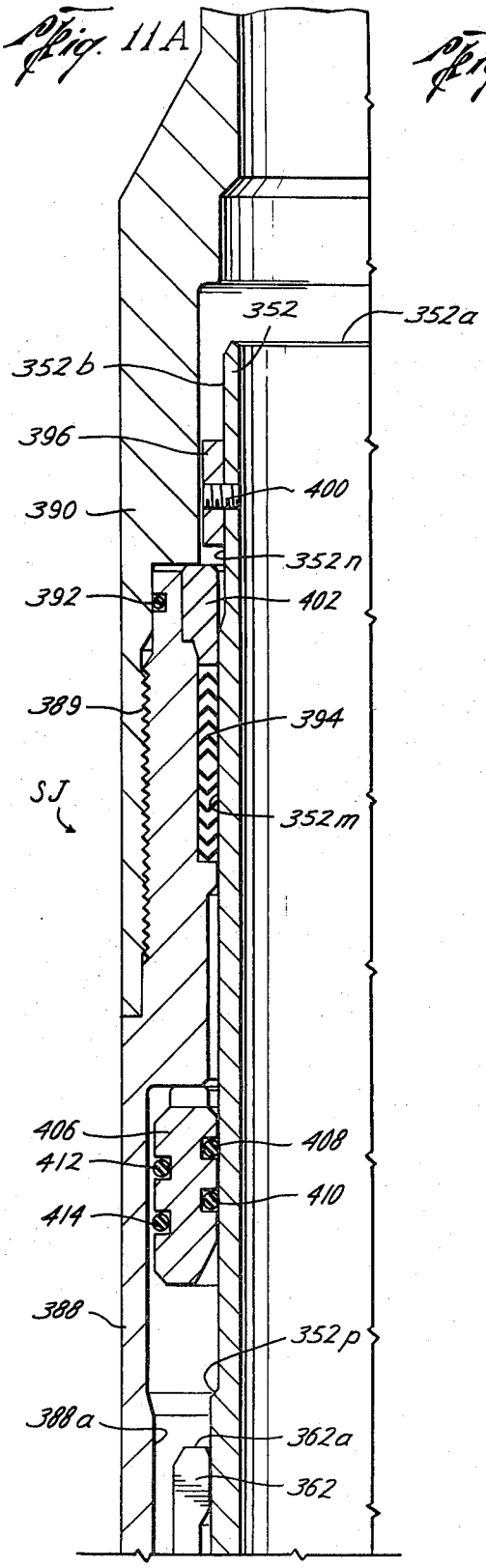
FIGS. 11A, 11B and 11C are side views in section, from top to bottom of the safety joint and holddown apparatus of the present invention when moving into the well.
Figure 11B:
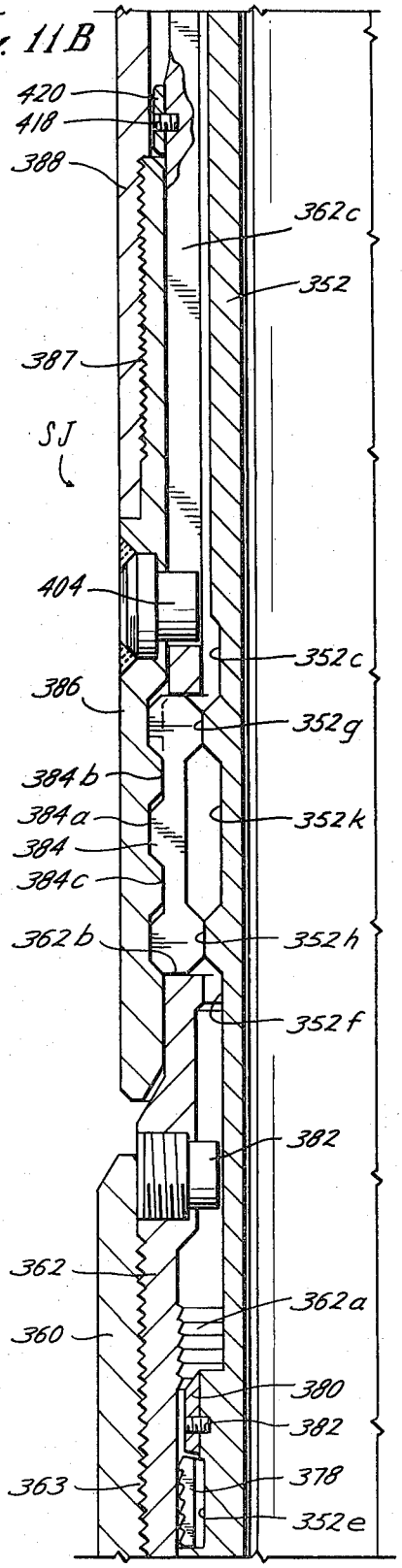
Figures 11C, 12:
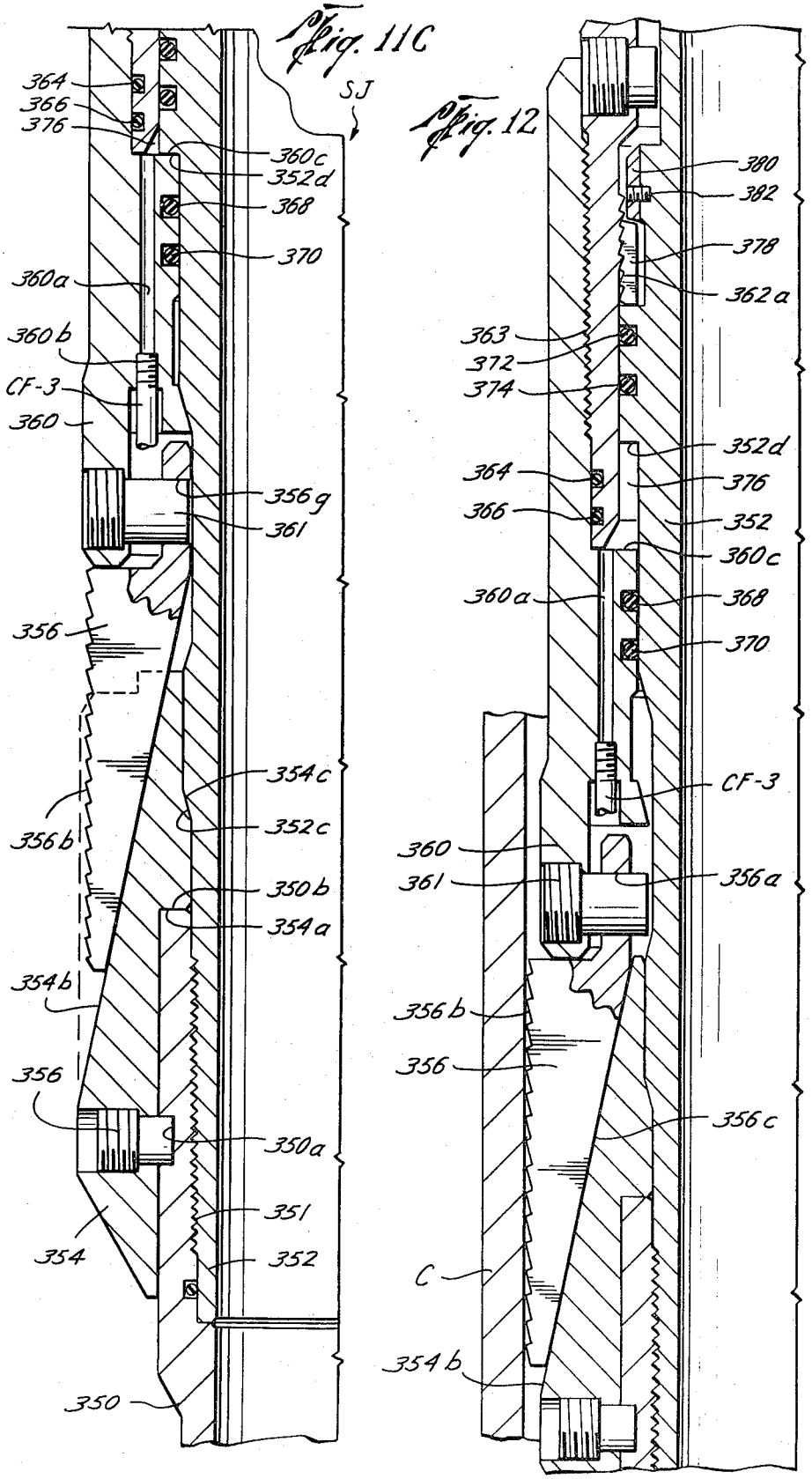
FIG. 12 is a side view, in section, similar to FIG. 11C illustrating the holddown operably installed in the well.

The holddown safety joint apparatus SJ of the present invention is illustrated in detail from top to bottom in FIGS. 11A–11C. The holddown and safety joint apparatus is actuated by the initial increase in control fluid pressure in conduit CF-2 communicated to an expansible chamber for effecting relative longitudinal movement in the holddown safety joint apparatus. This movement sets the holddown slips for maintaining the stinger 100 sealed within the subsurface tubing hanger STH and for actuating the safety joint SJ from the full strength condition when running into a condition in which separation is assured at the safety joint in the event of damage to the wellhead WH.

As illustrated in FIG. 11C, the safety joint apparatus SJ includes the lower tubular housing member 350 that is threadedly connected to a flow coupling (not illustrated) secured in the well tubing WT above the subsurface safety valve SSV. A flow passage defining inner tubular member 352 is threadedly secured to the member 350 by threaded engagement at 351. The flow passage defining inner mandrel member 352 extends upwardly for terminating at an upper annular shoulder 352a (FIG. 11A) for defining the full opening flow passage through the safety joint SJ. As will be disclosed in greater detail hereinafter, the flow passage member 352 is provided with a complex shaped outer surface 352b for achieving the purpose of the present invention as will be disclosed in fuller detail hereinafter.

Secured to the member 350 is a holddown slip wedge member 354 that is partially held together by threaded pins 356 engaging the recess 350*a* formed on the member 350. The outer surface 352*b* of the flow defining member 352 is also provided with a downwardly facing tapered annular shoulder 352*c* which engages a corresponding upwardly facing annular tapered shoulder 354*c* for assisting the threaded retaining pin 356 for preventing upward movement of the slip guide 354. The holddown slip wedge member 354 is provided with a downwardly facing annular shoulder 354*a* which engages the upwardly facing annular shoulder 350*b* of the member 350 for maintaining holddown slip guide 354 from downward movement relative to the members 350 and 352. The holddown slip wedge guide 354 is also provided with a tapered outer surface 354*b* upon which the holddown slips 356 move for expanding the slips 356 radially outwardly for engaging the casing C in the known manner as illustrated in FIG. 12.

The slips 356 are mounted with the slip retainer member 360 by threaded pin 361 that are received within recesses 356*a* of the slips. The use of the threaded pins 361 enables rapid replacement of the slips 356 without the need to disassemble the safety joint SJ. The slips 356 are provided with the casing engaging teeth 356*b* and a tapered surface 356*c* which engages the slip guide surface 354*b* for moving the slips 356 radially outwardly for engaging the casing C as the guide surface 354*b* moves upwardly relative to the slips 356 in a manner to be more fully described.

The slip retainer member 360 extends upwardly from attaching pins 361 for threadedly engaging an intermediate mandrel 362 at 363. The intermediate mandrel 362 extends upwardly outside the inner mandrel 352 until it terminates at upper annular shoulder 362*a* (FIG. 11A). A pair of O-rings 364 and 366 block leakage of fluid along threaded engagement at 363 of the slip securing members 360 and the intermediate mandrel 362.

The slip retainer member 360 is provided with an internal flow passage 360*a* having threaded end portion 360*b* that is connected to the control fluid conduit CF-3 which has its other end attached to the subsurface safety valve SSV in the manner previously indicated. Thus the fluid pressure in the balance control line CF-2 is communicated from the subsurface safety valve SSV through control fluid conduit CF-3 to the port 360*a*. The slip retaining member 360 also carries O-rings 368 and 370 for effecting a fluid pressure seal between the slip retainer member 360 and the flow passage defining inner mandrel 352.

The inner mandrel 352 forms a downwardly facing annular shoulder 352*d* which engages an upwardly facing annular shoulder 360*c* of the slip retainer member 360. The inner mandrel 352 carries a pair of O-rings 372 and 374 above the pressure responsive shoulder 352*d* for creating an expansible chamber 376 communicating with the passageway 360*a*. Fluid pressure within the chamber 376 will urge on the pressure responsive shoulder 352*d* of the inner mandrel 352 for moving the inner member upward relative to the slip retainer member 360 and which upward movement of the member 352 will move the slip wedges 354 upwardly for moving the holddown slips 356 radially outwardly to engage the casing C in the usual manner. The upward movement of the inner member 352 is enabled due to the range of movement allowed by the stinger 100 in the subsurface tubing hanger STH as previously described and which will be more fully disclosed in the description of the operation of the present invention.

Immediately above the O-rings 372 and 374 is a recess 352*e* in which is disposed a radially expandable locking ring 378. When the inner mandrel 352 moves upwardly adjacent the serrations 362*a* (FIG. 12) the locking ring 378 will engage the serrations 362*a* to prevent downward movement of the flow defining inner member 352 relative to the slip retainer member 360 for maintaining the slips 356 in the set radially expanded position. The locking ring 378 is secured in the recess 352*e* by a lock keeper ring 380 that is secured to the inner member 352 by a shear pin 382. When it is desired to release the slips 356, the shear pin 382 is sheared in a manner to be described hereinafter for enabling the inner mandrel 352 to move downward relative to the slips 356 and thereby moving the slip guide 354 from the slips 356 and enabling their radial inward movement.

Secured to the inner mandrel 352 above the serrations 362*a* is one or more threaded rotation transmitting pins 382 that are secured to the intermediate mandrel 362 that is movably received within a longitudinal groove 352*f* of the flow passage defining member 352. The purpose of the pins 382 is to transmit the rotation of the intermediate mandrel 362 to the inner mandrel 352 which can therefore be transmitted to the portion of the apparatus A below the lower housing member 350 and thus enable rotational movement through the apparatus A for setting the packer PP or for performing other well operations as desired when installing the present invention. The groove 352*f* provides longitudinal movement clearance between the inner mandrel 352 and the intermediate mandrel 362 for enabling setting of the holddown slips 356.

Disposed above the threaded pin 382 are a plurality of equi-circumferentially spaced windows 362*b* formed in the inner member 362. Disposed in each of the windows 362*b* is a weight supporting latch dog 384 which is held in the radially extended weight carrying position illustrated in FIG. 11B by locking surfaces 352*g* and 352*h* formed on the outer surface 352*b* of the inner member 352. Recesses 352*a*, 352*j* and 352*k* formed adjacent the latching surfaces 352*g* and 352*h* will enable the latch dog 384 to move radially inwardly when there is relative longitudinal movement between the latch dog 384 and the inner member 352. The outer surface 384*a* of the latch dog is provided with a pair of recesses 384*b* and 384*c* for forming both upwardly and downwardly facing annular shoulders for securing the latch dog 384 with corresponding shoulders of the outer tubular member or mandrel 386 against relative longitudinal motion therebetween when the latch dog 384 is in the radially expanded position. The outer mandrel 386 extends upwardly to engage an intermediate outer tubular member 388 by threaded engagement at 387. The intermediate attaching member 388 is connected at its upper end with the upper attachment member 390 by threaded engagement at 389. The upper attachment member 390 is threadedly connected to the well tubing WT above the safety joint SJ in the usual manner. An O-ring 392 carried by the intermediate connecting member 388 blocks leakage of fluid along the threaded engagement at 389.

The intermediate attaching member 388 carries a chevron packing 394 in the vicinity of the thread 389 for sealing between the intermediate attaching member 388 and inner surface 352 at a polished surface 352*m* formed on the outer surface 352*b* of the inner tubing member 352. A short distance above the polished sealing surface 352*m* the outer surface 352*d* is formed on a smaller diameter portion 352*n* which will not seal with the chevron packing 394 when placed adjacent thereto for a purpose to be described more fully hereinafter. Mounted on the reduced outer diameter surface 352*n* of the inner member 352 is a safety joint retainer ring 396 that is secured to the inner member 352 by a shear pin 400. When the safety joint latch dogs 384 are released by the longitudinal movement of the inner member 352 from longitudinal movement blocking engagement with the lower attachment member 386, the shear ring 396 provides the sole means for holding the attachment members 390, 388 and 386 from separation with the intermediate mandrel 362 and the inner mandrel 352. Thus, the shear pin 400 provides a safety connection for enabling the well tubing above the holddown slips 356 to part the well tubing WT at a tensile loading substantially half of that necessary to separate the well tubing WT. For example the value of 30,000 pounds may be selected to shear the shear pin 400 for effecting operation of the safety joint. Should the tubing WT be subjected to an upward stress of 30,000 pounds, the attachment member 388 will be moved upwardly for moving the shear and seal retaining cap 402 upwardly in engagement with the shear ring 396 for effecting failure of the shear pin 400. With such shearing the tubing well WT above the safety joint is free to move from the well W without effecting the set holddown slips 356 or the subsurface safety valve SSV which will then shut in the well.

A plurality of J-slot pins 404 secured with intermediate attaching member 388 are received in a corresponding plurality of recesses 362*c* disposed above the windows 362*b* of the intermediate mandrel 362.

Figure 13:
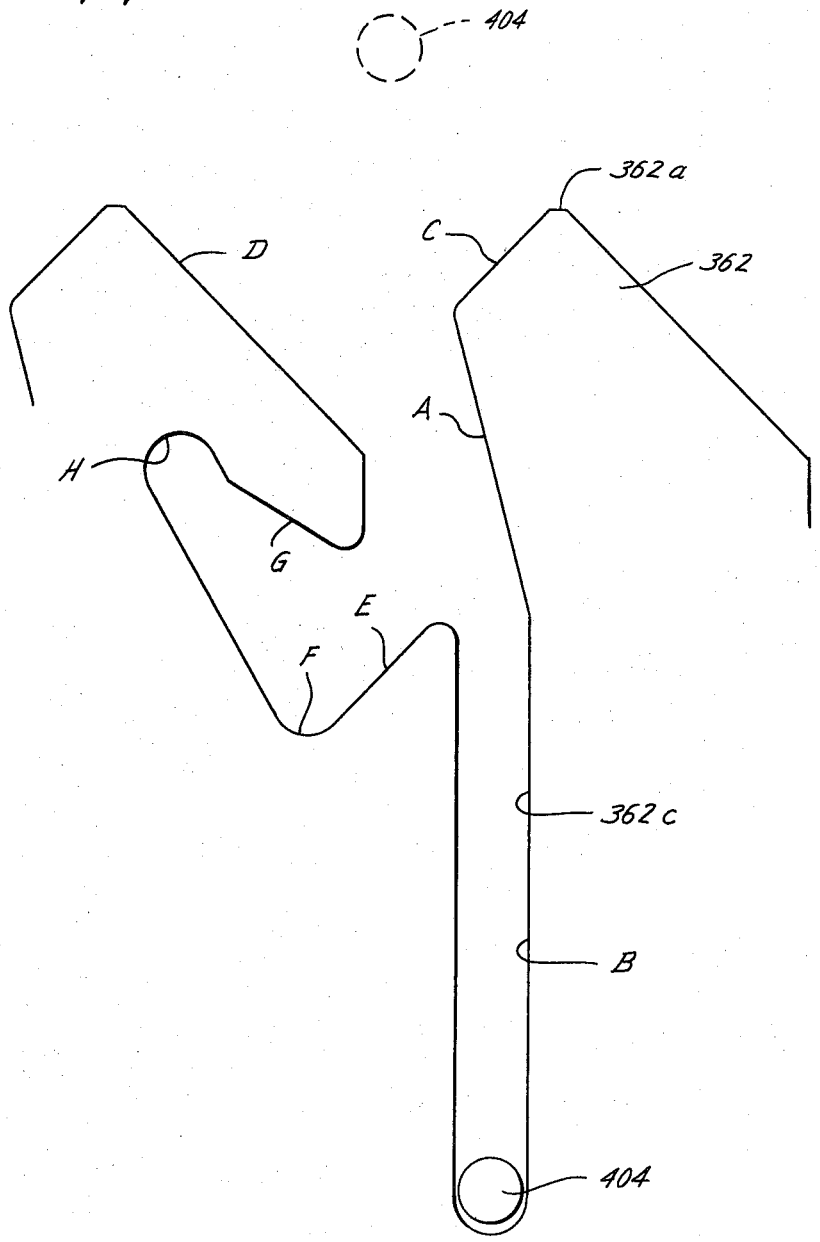
FIG. 13 is a schematic view of the J-slot arrangement of the apparatus for enabling its retrieval from the well when desired.

Preferably, three J-pins 404 are provided on the safety joint SJ and therefore each of the J-slots is formed over 120° arc of the intermediate tubing member 362. One of the J-slot channels 362*c* is illustrated in greater detail in FIG. 13 where the J-pin 404 is illustrated in the position it is held by the latch dogs 384 when going in the hole. When the attaching member 386 moves upwardly for shearing the shear pin 400 the J-pin 404 will move upwardly in the J-slot 362. After shearing pin 400 the J-pin 404 engages tapered surface referenced A which will move the J-pin 404 out of alignment with the vertical portion referenced as B of the slot 362. The J-pin 404 will be generally in the position illustrated in phantom in FIG. 13. Thereafter, when it is desired to reengage the J-pin 404 in the J-slot 362*c* the surfaces C and D will coact to direct the pin 404 in engagement with the surface E when the J-pin 404 is lowered. After reaching the location referenced as F, the operator can then pick back up on the well tubing WT and by the action of the surface G will move the J-pin 404 into the recess referenced as H for supporting the inner mandrel 362 in the well W. As the J-pin 404 is moved upwardly a preselected distance into the recess H the member 386 has moved upwardly relative to the inner mandrel 352 and the intermediate mandrel 362.

Since the outer members are now secured in a relatively higher position to the intermediate sleeve 362 and inner sleeve 360, the packing 394 is now disposed adjacent surface 357*n* and fluid pressure in the bore of the well tubing WT will pass between the inner mandrel 352 and the packing 394 to a pressure responsive releasing piston 406 disposed above the annular shoulder 362*a* of the intermediate mandrel 362. The piston 406 is provided with O-rings 408 and 410 for sealing with the inner surface 352*b* of the inner mandrel 352 which is also provided with an upwardly facing annular shoulder 352*p* in order that the fluid pressure that bypasses the chevron packing 394 will urge downwardly on the locking piston 406 and on the inner member 352 by the engagement of the releasing piston 406 in the shoulder 352*p*. In the relative upper position of the J-pin 404 the thicker wall portion 388*a* of the attaching member 388 is disposed adjacent the locking piston 406. A pair of O-rings 412 and 414 carried by piston 406 are then enabled to seal with the surface 388*a* for preventing bypass of the fluid around the locking piston 406. By the use of the locking piston 406 the pressure in the bore of the well tubing will urge downwardly on the piston 406. This urging is transmitted to the inner member 352 for moving the inner member 352 downwardly along with the slip guide member 354 for releasing the slips 356 by moving the support surface 354*b* downward relative to the slips 356. The slips 356 are prevented from downward movement by the J-pin 404 engaging the surface H of the recess 362*c* for pulling or urging the intermediate mandrel 362 upwardly.

During installation of the safety joint SJ, a shear pin 418 secures a keeper ring 420 for preventing relative longitudinal movement between the attachment sleeve 386 and the inner mandrel 362. The shear pin 418 merely serves to prevent relative longitudinal movement until the holddown wedges 356 are set and can be easily sheared at a relatively insignificant value.

USE AND OPERATION OF THE PRESENT INVENTION

In the use and operation of the present invention, the casing C is installed in the well W in the usual manner employing the derrick D located on the platform P. After the casing C is installed, it becomes desirable to install the subsurface safety valve system A. For producing well fluids through the bore of the well tubing WT a packer PP is employed at the lower end of the well tubing for directing the well fluids in the casing C through the bore of the well tubing WT in the usual manner. Sufficient tubing is added above the packer PP until it becomes desirable to locate the subsurface tubing hanger. Preferably, the subsurface safety valve SSV is located 200 to 500 feet below the mudline ML to enable retrieval by crane K. Accordingly, the subsurface tubing hanger STH is positioned in the well tubing WT after connecting a desired length of well tubing WT therebelow. A blast joint is connected between the stinger S that is received within the subsurface tubing hanger STH and has mounted at its upper end the subsurface safety valve SSV. Disposed above the subsurface safety valve is another blast joint which is connected to the lower end of the safety joint and holddown apparatus SJ. Sufficient well tubing WT is added above the safety joint for properly positioning the subsurface safety valve SSV in the well with the wellhead WH being connected into the well tubing WT with the production riser PR extending from the wellhead to the platform P. All of the aforementioned dimensioning and arranging, being well known to those skilled in the art.

When going in the well W, the subsurface tubing hanger STH is in the condition illustrated in FIGS. 2A–2C. Preferably the subsurface safety valve SSV in the open position in response to pressure in the bore of the well tubing WT to enable circulation down the well tubing WT and upwardly in the annular area between the well tubing and the casing C as is known in the art.

As the packer PP has not been actuated to set such circulation flow is enabled which tends to reduce striking of the apparatus A in the casing C during installation. As previously disclosed herein, the subsurface safety valve SSV is provided with capabilities of being pumped down through and therefore it is not necessary to use special tools to place the subsurface safety valve SSV in the open position.

While running in the well the safety joint SJ is in the condition illustrated in FIGS. 11A–11C with the weight supporting latch dogs 384 locked in the radially expanded position for supporting the weight of the well tubing below the attaching mandrel 386.

When the sealing plug SP seals in the plug catcher PC the fluid pressure will effect setting of the subsurface tubing hanger slips 50 by moving the slips 50 upwardly in engagement with the well casing C. As soon as the slips 50 are believed set, the operator can ease off on the support of the well tubing WT a small increment. If the weight indicator of the derrick D indicates a decrease in the tubing weight being supported by the derrick D the subsurface tubing hanger slips 50 are properly set and supporting the tubing hanger STH and well tubing WT as desired. If not, the well tubing WT is only necessary to move upwardly back to the preselected distance and pressure up the well tubing WT again. Once the slips 50 are set, the wellhead WH can be lowered into the well head bowl. In moving the wellhead into the bowl the stringer 100 will be moved downwardly relative to the ports 87 and 85 for isolating the operating chambers with packing 108 from well fluid pressure in the bore of the well tubing WT.

With the well tubing WT above the subsurface tubing hanger STH suspended from the wellhead WH pressure in the control line CF-2 may be increased. This increased control fluid pressure from the platform P is carried to the subsurface safety valve SSV and by means of control fluid conduit CF-3 is communicated to the safety joint SJ and in particular to the expansible chamber 376 where it elevates the inner mandrel 352, the subsurface safety valve SSV and the stinger 100 in the subsurface tubing hanger STH approximately three-quarters of an inch for setting the holddown slips 356. The lock ring 378 engaging the serrations 362*a* maintains or holds the inner mandrel 352 in the upper position. As also previously disclosed herein, the setting of the holddown slips 356 effects relative movement of the mandrel 352 relative to the inner mandrel 362 of the safety joint SJ for actuating the safety joint shear pin 400 by releasing the weight supporting latch dogs 384 from engagement with the attaching member 386.

Thereafter, the control fluid pressure in the conduit CF-2 may be vented in the control fluid conduit pressure CF-1 pressured up to effect opening of the subsurface safety valve ball 220. With the ball 220 rotated open the retrieving tool RT of FIG. 4 may be run down the bore of the well tubing WT for retrieving the plug catcher PC and the plug means PM from the subsurface tubing hanger STH in the detailed manner previously described herein. When the plug catcher PC, the plug means PM and the retrieving tool 154 are removed from the production riser PR at the platform P the well W is thus provided with the full bore opening through the well tubing WT from the packer PP to the platform P. At this time, perforating tools may be run to provide the perforations O in the casing C adjacent the producing formation F and/or swabbing tools may be run through the well tubing WT for bringing the well W into production. With the well under production, the subsurface safety valve SSV is normally maintained in the open position by increasing and maintaining control fluid pressure in conduit CF-1. Automatic as well as manual control fluid pressure means are provied at the platform P for controlling operation of the subsurface safety valve SSV. A control fluid enclosed automatic control system for a subsurface safety valve is disclosed in Wolff U.S. Pat. No. 4,082,147 which is assigned to the assignee of the present invention. Other automatic control means may also be used with the apparatus A of the present invention.

By properly locating the subsurface tubing hanger STH below the mudline ML so as not to exceed the crane lifting capacity the crane K can thereafter be used to effect replacement of the subsurface safety valve SSV when it malfunctions. This enables the drilling derrick D to be moved to a different platform and which results in a great savings to an operator. In addition, it does not require that a workover rig be maintained on the platform P or use for safety valve change out with that savings also available to the operator.

When it becomes necessary to replace the subsurface safety valve SSV, a plug is installed in the well tubing WT below the subsurface tubing hanger STH. Such plugs and their installation are well known to those skilled in the art and need not be disclosed in detail herein. With the well tubing WT below the subsurface tubing hanger STH plugged, the crane K can be connected to the production riser PR and used to apply sufficient tension to the well tubing WT to effect shearing of shear pin 400 by elevating attachment members 390 and 388. In the wellhead WH is located on the platform P the crane K to be connected directly to the wellhead WH and well tubing WT. With such shearing the J-pins 404 move upwardly through the slot 362*c* above the upper annular shoulder 362*a* in the manner indicated in FIG. 13. When the well tubing WT is elevated a sufficient distance above the upper annular shouler 362*a*, the crane operator will lower the production riser PR and enable the pins 404 to move downwardly where they will be guided to stop at the surface F by the shape of the slot 362*c*. Once the downward movement of the J-pin 404 is arrested by the surface F, the crane operator K elevates the tubing WT to position the J-pin 404 adjacent lifting surface H.

This, of course, again connects the attachment member 388 to the intermediate mandrel 362 for enabling the crane K to pull upwardly upon the inner mandrel 362 and thereby effect its support as well as that of the holddown slips 356. The relative longitudinal movement of the attaching member 388 to the inner mandrel 352 exposes pressure responsive piston 406 to the pressure in the bore of the well tubing WT by enabling passage of well fluids between the packing 394 and the recessed surface 352*n* of the inner mandrel. Thus while the crane K is pulling the inner mandrel 362 and the slips 356 upwardly fluid pressure in the bore of the well tubing is urging on the piston 406 for removing the inner mandrel 352 downwardly until shoulders 352*d* engages the upwardly facing annular shoulder 360 of the slip holder 360. This pressure urging effects the shearing of the shear pin 382 for releasing the latching ring 378 from the inner mandrel 352 in the upper position and enabling downward movement of the inner mandrel 352 to release the slips 356. With the holddown slips 356 released, it is only necessary to rotate the well tubing WT to the right while pick up on the stinger 100 for engaging the lugs 32*e* of the subsurface tubing hanger housing STH with the lugs 100*a* on the stinger. The right hand rotation will effect disengagement of the left hand threads 34 to enable the crane K to elevate the stinger 100 from the subsurface tubing hanger and enable retrieval of the stinger 100, the subsurface safety valve SSV and the safety and holddown SJ to the platform P.

With the stinger 100 withdrawn from the subsurface tubing hanger STH both ports 85 and 87 are exposed to well fluid pressure. However, as the tubing hanger slips 50 are set and supporting the weight of the well tubing WT the difference in the pressure responsive area of the two chambers 87 and 85 are insufficient to effect release of the slips 50 with the common well bore pressure.

A replacement full opening subsurface safety valve SSV and safety and holddown joint SJ are then connected or made up with well tubing and lowered down the well W until engagement with the subsurface tubing hanger STH. When going into the well W with a replacement safety valve SSV, the member 32 of the subsurface tubing hanger 32 is not required and can be safely stored on the platform P. The stinger can be merely run into the polish bore 26*m* of the subsurface tubing hanger and as the holddown and safety joint SJ provides the means for retaining the stinger 100 in the subsurface tubing hanger. The length of the polish bore 26*m* also serves as a means for "spacing out" the well tubing WT on the replacement trip. The pressure in the control fluid conduit CF-2 is then increased for effecting operation of the safety joint and holddown SJ at the desired location in the manner identical to that previously described. Thereafter, control of flow through the bore of the well tubing WT may be resumed in the usual manner with control fluid supplied through conduit CF-1. Should the safety valve SV again require replacement, it is only necessary to operate the safety joint SJ to shear the safety joint pins 400 and establish resupport by the J-pins 404 for pulling upwardly with the crane K while pressuring up the bore of the well tubing WT to effect release of the holddown and safety joint.

At some point, it may be desirable to recover the packer PP or the subsurface tubing hanger STH. When this is desired, the stinger 100 is retrieved by releasing in the appropriate manner previously described and a work string (not illustrated) is made up on the platform and run into the well W. The workover string is provided with a thread adapted to be made up with the thread 22*e* of the subsurface tubing hanger STH. When the thread 22*e* is made up the work string is elevated for moving the slip support surface 22*c* above the subsurface tubing hanger slips 50. To effect this upward movement, it may be necessary to reinstall a workover rig or derrick D as capacity of the crane K may be insufficient to lift the entire tubing string WT. The well tubing WT and the packer PP are then retrieved back to the platform P along with the apparatus A of the present invention in the usual manner.

The foregoing disclosure and description of the invention are illustrative and explanatory thereof, and various changes in the size, shape and materials as well as in the details of the illustrated construction may be made without departing from the spirit of the invention.

I claim:

1. A method of operably installing in a single trip a well safety system having a full opening remote controlled subsurface safety valve in the well, including the steps of:

connecting a subsurface tubing hanger in a string of well tubing;

connecting the full opening remote controlled subsurface safety valve in the well tubing above the subsurface tubing hanger;

connecting a full-strength safety joint in the well tubing above the full opening remote controlled subsurface safety valve;

connecting a predetermined amount of well tubing above the subsurface safety valve while moving the subsurface safety valve in the well;

mounting a wellhead hanger above the predetermined amount of well tubing;

positioning the wellhead hanger a predetermined distance above the wellhead;

determining the weight supported by the wellhead hanger when positioned the predetermined distance above the wellhead;

setting the subsurface tubing hanger in the well for supporting the string of well tubing below the subsurface tubing hanger;

lowering the wellhead hanger into the wellhead;

determining the weight supported by the wellhead hanger while lowering the wellhead hanger into the wellhead;

comparing the weight supported determinations to develop a sufficient difference to indicate the subsurface tubing hanger is supporting the portion of the well tubing suspended therefrom;

activating the safety joint to reduce the strength of the safety joint; and operating the subsurface safety valve to enable flow through the well tubing.

* * * * *